US009830862B2

(12) United States Patent
Toyomura

(10) Patent No.: US 9,830,862 B2
(45) Date of Patent: Nov. 28, 2017

(54) DISPLAY DEVICE AND ELECTRONIC APPARATUS

(71) Applicant: JOLED INC., Tokyo (JP)

(72) Inventor: Naobumi Toyomura, Kanagawa (JP)

(73) Assignee: JOLED Inc., Tokyo (JP)

( * ) Notice: Subject to any disclaimer, the term of this patent is extended or adjusted under 35 U.S.C. 154(b) by 394 days.

(21) Appl. No.: 14/447,857

(22) Filed: Jul. 31, 2014

(65) Prior Publication Data

US 2015/0077441 A1 Mar. 19, 2015

(30) Foreign Application Priority Data

Sep. 18, 2013 (JP) ..... 2013-192627

(51) Int. Cl.

| | |
|---|---|
| ***G09G 5/10*** | (2006.01) |
| ***G09G 3/3291*** | (2016.01) |
| ***G09G 3/3233*** | (2016.01) |

(52) U.S. Cl.

CPC ..... *G09G 3/3291* (2013.01); *G09G 3/3233* (2013.01); *G09G 2300/023* (2013.01); *G09G 2300/0814* (2013.01); *G09G 2300/0819* (2013.01); *G09G 2300/0842* (2013.01); *G09G 2310/08* (2013.01); *G09G 2320/045* (2013.01)

(58) Field of Classification Search

CPC combination set(s) only.

See application file for complete search history.

(56) References Cited

U.S. PATENT DOCUMENTS

2006/0170628 A1* 8/2006 Yamashita ..... G09G 3/3233 345/76

2006/0244694 A1 11/2006 Kim et al.

(Continued)

FOREIGN PATENT DOCUMENTS

CN 1704995 A 12/2005

CN 1815538 A 8/2006

(Continued)

OTHER PUBLICATIONS

Office Action from Chinese Patent Office Action for Application No. 201410461446.4 dated Feb. 23, 2017.

*Primary Examiner* — Jennifer Mehmood

*Assistant Examiner* — Sosina Abebe

(74) *Attorney, Agent, or Firm* — Michael Best & Friedrich LLP

(57) ABSTRACT

A display device includes: a sampling transistor sampling a signal voltage of a video signal; a holding capacitor holding the signal voltage sampled by the sampling transistor; and a pixel circuit including a driving transistor that drives a light-emitting portion according to the signal voltage held in the holding capacitor. The light-emitting portion is formed by stacking at least two electro-optic elements, an uppermost electrode is connected to one source or drain electrode of the driving transistor, and a lowermost electrode is connected to a node of a reference potential. A potential of an intermediate node between the uppermost electrode and the lowermost electrode at a time of extinction is set with a potential relation in which the potential of the intermediate node is lower than a threshold voltage of the electro-optic element on a side of the reference potential and is higher than the reference potential.

13 Claims, 14 Drawing Sheets

(56) References Cited

U.S. PATENT DOCUMENTS

| | | | | |
|---|---|---|---|---|
| 2007/0064422 | A1* | 3/2007 | Murai | G09G 3/3413 362/231 |
| 2008/0079360 | A1* | 4/2008 | Kubota | H05B 33/04 313/505 |
| 2009/0091562 | A1* | 4/2009 | Uchino | G09G 3/3233 345/214 |
| 2010/0252841 | A1* | 10/2010 | Cok | H01L 27/3209 257/89 |
| 2011/0309340 | A1* | 12/2011 | Schmid | H01L 51/0067 257/40 |
| 2013/0127370 | A1 | 5/2013 | Yamamoto et al. | |

FOREIGN PATENT DOCUMENTS

| | | | |
|---|---|---|---|
| CN | 101136170 | A | 3/2008 |
| CN | 101160001 | A | 4/2008 |
| CN | 103017015 | A | 4/2013 |
| JP | 2007-310311 | A | 11/2007 |

* cited by examiner

DISPLAY DEVICE AND ELECTRONIC APPARATUS

CROSS REFERENCE TO RELATED APPLICATIONS

This application claims the benefit of Japanese Priority Patent Application JP 2013-192627 filed Sep. 18, 2013, the entire contents of which are incorporated herein by reference.

BACKGROUND

The present disclosure relates to a display device and an electronic apparatus, and more particularly, to a plane type (flat panel type) display device formed such that pixels including light-emitting portions are arranged in a matrix form (matrix shape) and an electronic apparatus including the display device.

As one of the plane type display devices, for example, there is an organic EL display device in which an organic electro-luminescence (hereinafter referred to as "organic EL") element is used as a light-emitting portion of a pixel. The organic EL element is a light-emitting element that uses electro-luminescence (EL) of an organic material and utilizes a phenomenon in which light is emitted when an electric field is applied to an organic thin film.

In a plane type display device typified by an organic EL display device, a driving circuit driving a light-emitting portion is configured to include at least a sampling transistor, a holding capacitor, and a driving transistor (for example, see Japanese Unexamined Patent Application Publication No. 2007-310311). The sampling transistor samples a signal voltage of a video signal. The holding capacitor holds the signal voltage sampled by the sampling transistor. The driving transistor drives the light-emitting portion according to the signal voltage held in the holding capacitor.

SUMMARY

In the plane type display device including the driving circuit with the foregoing configuration, e.g., in an organic EL display device in which a light-emitting portion is formed by an organic EL element, the following problems may occur when a state in which a reverse-direction voltage (reverse bias voltage) is applied to the light-emitting portion continues for a long time. The organic EL element shows characteristics of a diode. However, even when a reverse bias voltage is applied, a leakage current is known to flow. For this reason, when a reverse bias state continues for a long time, a source potential of the driving transistor increases due to the influence of the leakage current and a gate potential also increases due to capacity coupling by the holding capacitor. Then, since the gate potential of the driving transistor immediately before writing of the signal voltage becomes a potential higher than a desired potential, an effective signal voltage written on a gate electrode of the driving transistor is compressed, and thus desired luminance may not be obtained.

Here, the problem of the related art has been described exemplifying the case of the organic EL display device formed such that the light-emitting portion is formed by the organic EL element. However, this problem can be said to be a problem occurring generally in a display device using a light-emitting element (electro-optic element), in which a leakage current flows in the reverse bias state as in the organic EL element, as a light-emitting portion.

It is desirable to provide a display device capable of performing display at a desired luminance corresponding to a signal voltage written on a gate electrode of a driving transistor and an electronic apparatus including the display device.

According to an embodiment of the present disclosure, there is provided a display device including: a sampling transistor configured to sample a signal voltage of a video signal; a holding capacitor configured to hold the signal voltage sampled by the sampling transistor; and a pixel circuit configured to include a driving transistor that drives a light-emitting portion according to the signal voltage held in the holding capacitor. The light-emitting portion is formed by stacking at least two electro-optic elements, an uppermost electrode is connected to one source or drain electrode of the driving transistor, and a lowermost electrode is connected to a node of a reference potential. A potential of an intermediate node between the uppermost electrode and the lowermost electrode at a time of extinction is set with a potential relation in which the potential of the intermediate node is lower than a threshold voltage of the electro-optic element on a side of the reference potential and is higher than the reference potential.

According to another embodiment of the present disclosure, there is provided an electronic apparatus that includes a display device including a sampling transistor configured to sample a signal voltage of a video signal, a holding capacitor configured to hold the signal voltage sampled by the sampling transistor, and a pixel circuit configured to include a driving transistor that drives a light-emitting portion according to the signal voltage held in the holding capacitor. The light-emitting portion is formed by stacking at least two electro-optic elements, an uppermost electrode is connected to one source or drain electrode of the driving transistor, and a lowermost electrode is connected to a node of a reference potential. A potential of an intermediate node between the uppermost electrode and the lowermost electrode at a time of extinction is set with a potential relation in which the potential of the intermediate node is lower than a threshold voltage of the electro-optic element on a side of the reference potential and is higher than the reference potential.

In the light-emitting portion formed by stacking at least two electro-optic elements, a forward direction voltage is applied to the electro-optic element on the side of the reference potential when the potential of an intermediate node at the time of extinction satisfies a potential relation in which the potential of the intermediate node is lower than the threshold voltage of the electro-optic element on the side of the reference potential and is higher than the reference potential. Therefore, the potential of the intermediate node is shifted in a falling direction and the potential of the uppermost electrode is also shifted in a decreasing direction due to capacitance coupling of the equivalent capacitance of the electro-optic element on the side of the driving transistor and the holding capacitor. Thus, even when the light-emitting portion is in a reverse bias state, it is possible to prevent the potential of one source or drain electrode of the driving transistor from increasing, and furthermore prevent the gate potential from increasing. Accordingly, an effective signal voltage written on the gate electrode of the driving transistor is not compressed.

According to the embodiments of the present disclosure, when the light-emitting portion is in the reverse bias state, an effective signal voltage written on the gate electrode of the driving transistor is not compressed. Therefore, it is possible to realize display at the desired luminance corresponding to the signal voltage.

The advantages described herein are not necessarily limited and any advantage described in the present specification may be obtained. Further, the advantages described in the present specification are merely examples, and embodiments of the present disclosure is not limited thereto. Additional advantages may be obtained.

DETAILED DESCRIPTION OF EMBODIMENTS

Figure 1:
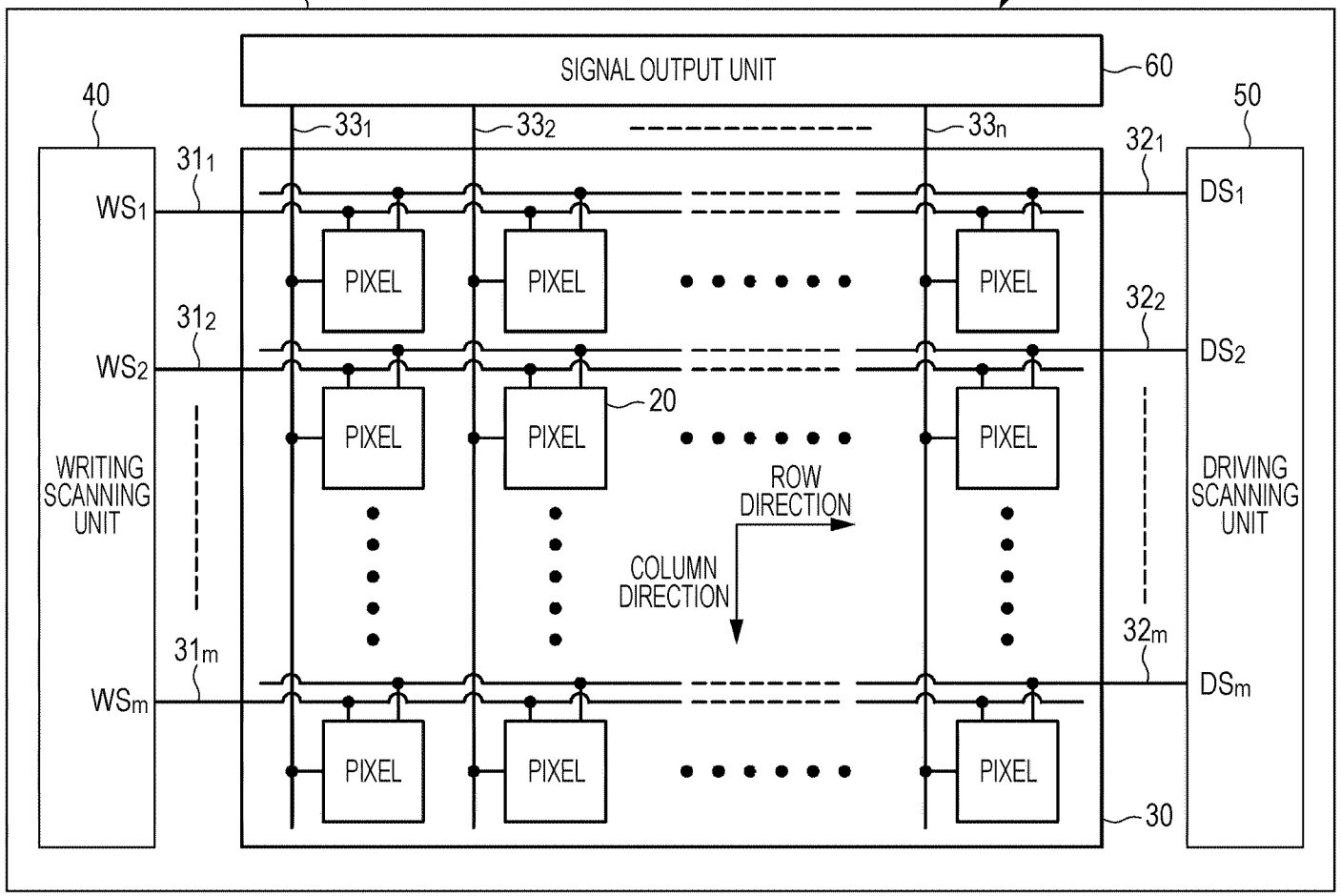
FIG. 1 is a system configuration diagram illustrating an overview of a basic configuration of an active matrix type display device to which a technology of the present disclosure is applied.

Hereinafter, modes (hereinafter referred to as "embodiments") for carrying out a technology of the present disclosure will be described in detail with reference to the drawings. The technology of the present disclosure is not limited to the embodiments. In the following description, the same reference numerals are given to the same elements or elements having the same functions and the repeated description will be omitted. The description is made in the following order.

1. General Description of Display Device, Method of Driving Display Device, and Electronic Apparatus according to Embodiment of the Present Disclosure
2. Display Device to Which Technology of the Present Disclosure Is Applied
   - 2-1. System Configuration
   - 2-2. Pixel Circuit
   - 2-3. Basic Circuit Operation
3. Display Device according to Embodiments
   - 3-1. First Embodiment
   - 3-2. Second Embodiment
4. Modification Examples
   - 4-1. First Modification Example
   - 4-2. Second Modification Example
5. Electronic Apparatus General Description of Display Device, Method of Driving Display Device, and Electronic Apparatus according to Embodiment of the Present Disclosure A display device according to an embodiment of the present disclosure is a plane type (flat panel type) display device formed such that a pixel circuit including a sampling transistor, a holding capacitor, and a driving transistor is disposed. Examples of the plane type display device include an organic EL display device, a liquid crystal display device, and a plasma display device. Of these display devices, the organic EL display device uses an organic EL element, which uses electro-luminescence of an organic material and utilizes a phenomenon in which light is emitted when an electric field is applied to an organic thin film, as a light-emitting element (electro-optic element) of a pixel.

The organic EL display device using the organic EL element as the light-emitting portion of a pixel has the following characteristics. That is, since the organic EL element can be driven with an application voltage equal to or less than 10 V, the organic EL display device consumes a low amount of power. Since the organic EL element is a self-luminous element, visibility of an image is higher in the organic EL display device than in a liquid crystal display device which is the same kind of plane type display device. Further, since an illumination member such as a backlight unit is not necessary, weight reduction and thinning are easy. Since a response speed of the organic EL element is about a few microseconds and thus is very fast, a residual image does not occur at the time of display of a moving image in the organic EL display device.

The organic EL element configured as the light-emitting portion is not only a self-luminous element but also a current driving type electro-optic element of which light emission luminance varies according to a current value flowing in a device. Examples of the current driving type electro-optic element include an inorganic EL element, an LED element, and a semiconductor laser element in addition to an organic EL element.

The plane type display device such as an organic EL display device can be used as a display unit (display device) in various kinds of electronic apparatuses including the display unit. Examples of the various kind of electronic apparatuses include portable information apparatuses such as digital cameras, video cameras, game apparatuses, notebook-type personal computers, and electronic books or portable communication apparatuses such as personal digital assistants (PDAs) or portable telephones.

In the display device and the electronic apparatuses according to an embodiment of the present disclosure, the potential of an intermediate node at the time of extinction may be determined by capacitance values of at least two electro-optic elements. At this time, the capacitance value of the electro-optic element on the side of the reference potential may be greater than the capacitance value of the electro-optic element on the side of the driving transistor.

In the display device and the electronic apparatus having the above-described preferred configuration according to an embodiment of the present disclosure, the electro-optic element may include two electrodes with a light-emitting layer interposed therebetween. At this time, the capacitance values of at least the two electro-optic elements may be determined in accordance with a difference in a distance between the two electrodes.

In the display device and the electronic apparatus having the above-described preferred configuration according to an embodiment of the present disclosure, threshold correction of the driving transistor may be performed during a first-half division period of division periods divided from one display frame period, and signal writing (sampling of the signal voltage) may be performed by the sampling transistor during a second-half division period. At this time, the second-half division period may be set to be longer than the first-half division period.

In the display device and the electronic apparatus having the above-described preferred configuration according to an embodiment of the present disclosure, the threshold correction may be performed by varying a potential of the one source or drain electrode of the driving transistor toward a potential obtained by reducing a threshold voltage of the driving transistor from an initialization potential of a gate potential of the driving transistor using the initialization potential as a reference.

In the display device and the electronic apparatus having the above-described preferred configuration according to an embodiment of the present disclosure, during the first-half division period, a reference voltage determining the initialization potential of the driving transistor may be applied to the gate electrode of the driving transistor. Further, the reference voltage may be supplied to a signal line supplied with the signal voltage of the video signal at a different timing from the signal voltage. The sampling transistor may apply the reference voltage to the gate electrode of the driving transistor by sampling the reference voltage supplied to the signal line.

In the display device and the electronic apparatus having the above-described preferred configuration according to an embodiment of the present disclosure, during the second-half division period, mobility correction of the driving transistor may be performed. The mobility correction may be performed by applying negative feedback to the holding capacitor by a feedback amount in accordance with a current flowing in the driving transistor.

In the display device and the electronic apparatus having the above-described preferred configuration according to an embodiment of the present disclosure, a combination scanning period including first and second periods may be set in accordance with in accordance with scanning periods allocated to a plurality of pixel rows. Further, threshold correction may be performed concurrently on the plurality of pixel rows during the first period, and the signal voltage may be sampled by the sampling transistor sequentially on the plurality of pixel rows during the second period.

Display Device to which Technology of the Present Disclosure is Applied

System Configuration

FIG. 1 is a system configuration diagram illustrating an overview of a basic configuration of an active matrix type display device to which a technology of the present disclosure is applied.

The active matrix type display device is a display device in which a current flowing in an electro-optic element is controlled by an active element provided in the same pixel as a pixel of the electro-optic element, e.g., an insulated gate field effect transistor. A thin film transistor (TFT) can be generally used as the insulated gate field effect transistor.

Here, for example, the case of an active matrix type organic EL display device using, for example, an organic EL element, which is a current driving type electro-optic element of which light emission luminance varies according to a current value flowing in the device, as a light-emitting element (light-emitting portion) of a pixel (pixel circuit) will be described as an example. A "pixel circuit"is simply referred to as a "pixel" in the following description in some cases.

As illustrated in FIG. 1, an organic EL display device 10 assumed in an embodiment of the present disclosure is configured to include a pixel array unit 30 formed such that a plurality of pixels 20 including an organic EL element are two-dimensionally arranged in a matrix form (matrix shape) and a driving circuit unit (driving unit) disposed in the periphery of the pixel array unit 30. The driving circuit unit is formed by, for example, a writing scanning unit 40, a driving scanning unit 50, and a signal output unit 60 mounted on the same display panel 70 as a display panel of the pixel array unit 30 and drives each pixel 20 of the pixel array unit 30. It is also possible to adopt a configuration in which one or all of the writing scanning unit 40, the driving scanning unit 50, and the signal output unit 60 are provided outside of the display panel 70.

Here, when the organic EL display device 10 corresponds to color display, one pixel (unit pixel/pixel) which is a unit in which a color image is formed includes a plurality of sub-pixels. At this time, each of the sub-pixels corresponds to the pixel 20 in FIG. 1. More specifically, in a display device corresponding to color display, for example, one pixel includes three sub-pixels, i.e., a sub-pixel emitting red (R) light, a sub-pixel emitting green (G) light, and a sub-pixel emitting blue (B) light.

However, one pixel is not limited to the combination of the sub-pixels of three primary colors RGB and one pixel can be configured by adding a sub-pixel of one color or sub-pixels of a plurality of colors to the sub-pixels of the three primary colors. More specifically, for example, one pixel can also be configured by adding a sub-pixel emitting white (W) light in order to improve luminance or one pixel can also be configured by adding at least one sub-pixel emitting complementary color light in order to expand a color reproduction range.

In the arrangement of the pixels 20 of m rows and n columns of the pixel array unit 30, scanning lines 31 ($\mathbf{31}_1$ to $\mathbf{31}_m$) and power supply lines 32 ($\mathbf{32}_1$ to $\mathbf{32}_m$) are each wired in the row direction (pixel arrangement direction of the pixel row/horizontal direction) for each pixel row. Further, in the arrangement of the pixels 20 of m rows and n columns, signal lines 33 ($\mathbf{33}_1$ to $\mathbf{33}_n$) are each wired in the column direction (pixel arrangement direction of the pixel column/vertical direction) for each pixel column.

The scanning lines $\mathbf{31}_1$ to $\mathbf{31}_m$ are connected to output terminals of the corresponding rows of the writing scanning unit 40, respectively. The power supply lines $\mathbf{32}_1$ to $\mathbf{32}_m$ are connected to output terminals of the corresponding rows of the driving scanning unit 50, respectively. The signal lines $\mathbf{33}_1$ to $\mathbf{33}_n$ are connected to output terminals of the corresponding columns of the signal output unit 60, respectively.

The writing scanning unit 40 is configured to include a shift register circuit. When a signal voltage of a video signal is written on each pixel 20 of the pixel array unit 30, the writing scanning unit 40 sequentially supplies writing scanning signals WS ($WS_1$ to $WS_m$) to the scanning lines 31 ($\mathbf{31}_1$ to $\mathbf{31}_m$) to sequentially scan the pixels 20 of the pixel array unit 30 in units of rows, i.e., to perform so-called line sequential scanning.

The driving scanning unit 50 is configured to include a shift register circuit, as in the writing scanning unit 40. The driving scanning unit 50 supplies the power supply lines 32 ($\mathbf{32}_1$ to $\mathbf{32}_m$) with power potentials DS ($DS_1$ to $DS_m$) which can switch between a first power potential $V_{cc_H}$ and a second power potential $V_{cc_L}$ lower than the first power potential $V_{cc_H}$ in synchronization with the line sequential scanning by the writing scanning unit 40. As will be described below, light emission and light non-emission (extinction) of the pixels 20 can be controlled through the switching between $V_{cc_H}$ and $V_{cc_L}$ of the power potentials DS by the driving scanning unit 50.

The signal output unit 60 selectively outputs a reference voltage $V_{ofs}$ and a signal voltage of a video signal (hereinafter simply referred to as a "signal voltage" in some cases) $V_{sig}$ according to luminance information supplied from a signal supply source (not illustrated). Here, the reference voltage $V_{ofs}$ is a voltage (for example, a voltage corresponding to a black level of a video signal) serving as a reference of the signal voltage $V_{sig}$ of the video signal and is used when a threshold correction process to be described below is performed.

The signal voltage $V_{sig}$ and the reference voltage $V_{ofs}$ output from the signal output unit 60 are written on each pixel 20 of the pixel array unit 30 via the signal lines 33 ($\mathbf{33}_1$ to $\mathbf{33}_n$) in units of pixel rows selected through the scanning by the writing scanning unit 40. That is, the signal output unit 60 adopts a driving form of line sequential writing in which the signal voltage $V_{sig}$ is written in units of rows (lines).

Pixel Circuit

Figure 2:
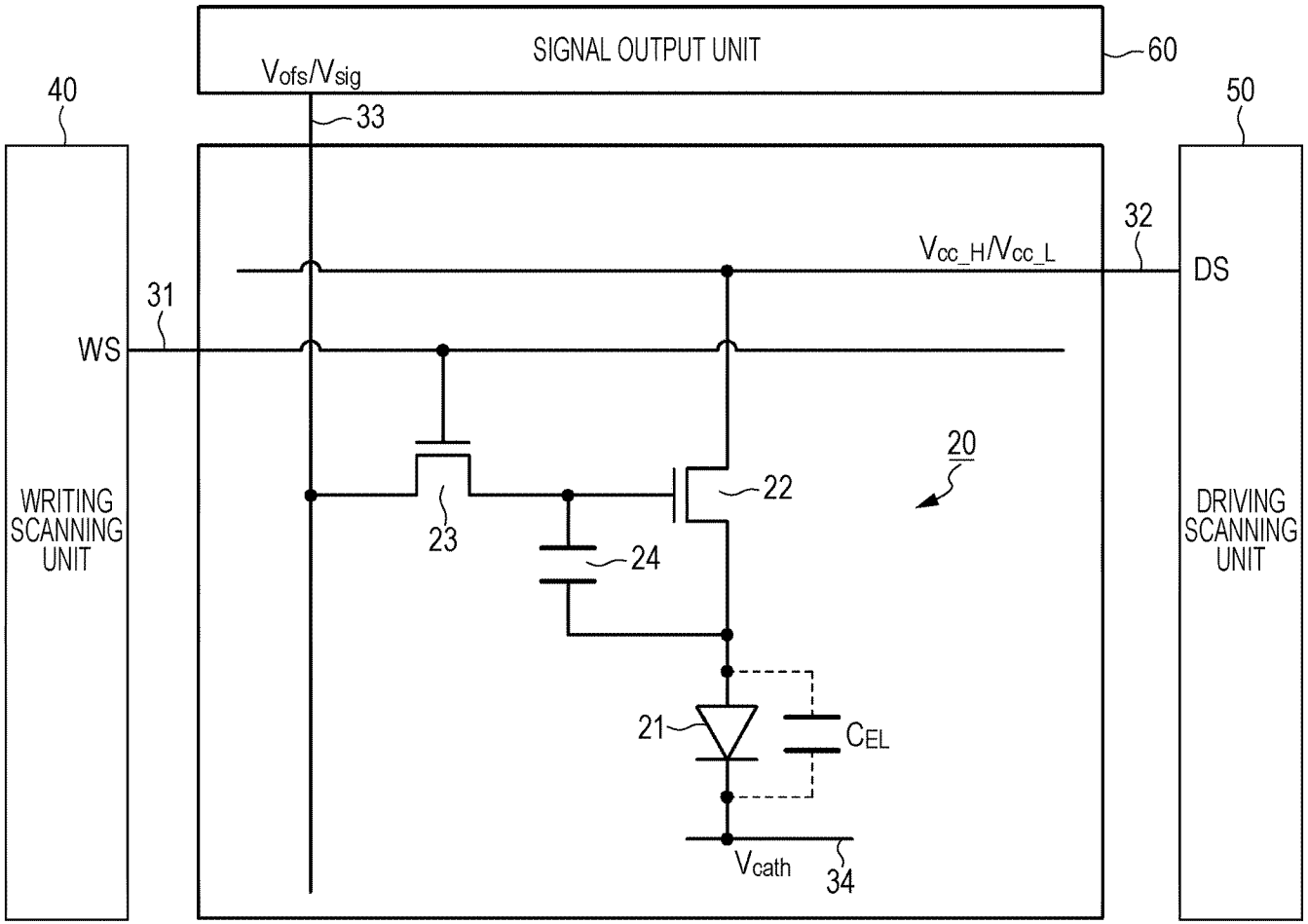
FIG. 2 is a circuit diagram illustrating an example of a specific circuit configuration of a pixel (pixel circuit)

FIG. 2 is a circuit diagram illustrating an example of a specific circuit configuration of the pixel (pixel circuit) 20. The light-emitting portion of the pixel 20 is formed by an organic EL element 21 which is a current driving type electro-optic element of which light emission luminance varies according to a current value flowing in the device.

As illustrated in FIG. 2, the pixel 20 is configured to include the organic EL element 21 and a driving circuit that drives the organic EL element 21 by allowing a current to flow in the organic EL element 21. A cathode electrode of the organic EL element 21 is connected to a common power line 34 wired commonly to all of the pixels 20. In FIG. 2, equivalent capacitance $C_{EL}$ of the organic EL element 21 is illustrated.

The driving circuit driving the organic EL element 21 is configured to include a driving transistor 22, a sampling transistor 23, and a holding capacitor 24. N channel TFTs can be used as the driving transistor 22 and the sampling transistor 23. However, the combination of conductive types of the driving transistor 22 and the sampling transistor 23 exemplified herein is merely an example, an embodiment of the present disclosure is not limited to the combination.

One electrode (source or drain electrode) of the driving transistor 22 is connected to the anode electrode of the organic EL element 21 and the other electrode (source or drain electrode) thereof is connected to the power supply line 32 ($\mathbf{32}_1$ to $\mathbf{32}_m$).

One electrode (source or drain electrode) of the sampling transistor 23 is connected to the signal line 33 ($\mathbf{33}_1$ to $\mathbf{33}_n$) and the other electrode (source or drain electrode) thereof is connected to the gate electrode of the driving transistor 22. The gate electrode of the sampling transistor 23 is connected to the scanning line 31 ($\mathbf{31}_1$ to $\mathbf{31}_m$).

In the driving transistor 22 and the sampling transistor 23, one electrode refers to a metal wiring electrically connected to one source or drain region and the other electrode refers to a metal wiring electrically connected to the other source or drain region. By a potential relation between the one electrode and the other electrode, when one electrode serves as a source electrode, the other electrode serves as a drain electrode. When the other electrode serves as a source electrode, the one electrode serves as a drain electrode.

One electrode of the holding capacitor 24 is connected to the gate electrode of the driving transistor 22 and the other electrode thereof is connected to one electrode of the driving transistor 22 and the anode electrode of the organic EL element 21.

In the pixel 20 having the foregoing configuration, the sampling transistor 23 enters a conductive state in response to the high active writing scanning signal WS applied from the writing scanning unit 40 to the gate electrode via the scanning line 31. Thus, the sampling transistor 23 samples the reference voltage $V_{ofs}$ or the signal voltage $V_{sig}$ of the video signal according to the luminance information supplied at different timings from the signal output unit 60 via the signal line 33 and writes the reference voltage $V_{ofs}$ or the signal voltage $V_{sig}$ on the pixel 20. The reference voltage $V_{ofs}$ or the signal voltage $V_{sig}$ written by the sampling transistor 23 are applied to the gate electrode of the driving transistor 22 and are held in the holding capacitor 24.

When the power potential DS of the power supply line 32 ($\mathbf{32}_1$ to $\mathbf{32}_m$) is the first power potential $V_{cc_H}$, one electrode and the other electrode of the driving transistor 22 serve as the drain electrode and the source electrode, respectively, and the driving transistor 22 operates in a saturation region. Thus, the driving transistor 22 receives a current from the power supply line 32 and performs light emission driving on the organic EL element 21 through current driving. More specifically, the driving transistor 22 operates in the saturation region, and thus supplies the organic EL element 21 with a driving current of a current value according to the voltage value of the signal voltage $V_{sig}$ held in the holding capacitor 24, so that the organic EL element 21 emits light through the current driving.

When the power potential DS is switched from the first power potential $V_{cc_H}$ to the second power potential $V_{cc_L}$, one electrode and the other electrode of the driving transistor 22 serve as the source electrode and the drain electrode, respectively, and thus the driving transistor 22 operates as a switching transistor. Thus, the driving transistor 22 stops supplying the driving current to the organic EL element 21, and thus the organic EL element 21 enters a light non-emission state. That is, the driving transistor 22 also functions as a transistor controlling light emission and light non-emission of the organic EL element 21 under the switching of the power potential DS ($V_{cc_H}/V_{cc_L}$).

Through the switching operation of the driving transistor 22, a period (light non-emission period) in which the organic EL element 21 enters a light non-emission state is provided and a ratio (duty) between the light emission period and the light non-emission period of the organic EL element 21 can be controlled. Since residual image blur caused by light emission of the pixel over one display frame period can be reduced by the duty control, in particular, image quality of a moving image can be further improved.

Of the first power potential $V_{cc_H}$ and the second power potential $V_{cc_L}$ selectively supplied from the driving scanning unit 50 via the power supply line 32, the first power potential $V_{cc_H}$ is a power potential for supplying the driving transistor 22 with a driving current used to perform the light emission driving on the organic EL element 21. The second power potential $V_{cc_L}$ is a power potential for applying a reverse bias to the organic EL element 21. The second power potential $V_{cc_L}$ is set as a potential lower than the reference voltage $V_{ofs}$, e.g., a potential lower than $V_{ofs}-V_{th}$ when $V_{th}$ is assumed to be a threshold voltage of the driving transistor 22, and is preferably set as a potential sufficiently lower than $V_{ofs}-V_{th}$.

Basic Circuit Operation

Next, a basic circuit operation of the organic EL display device 10 having the foregoing configuration will be described with reference to the timing chart of FIG. 3 and operation description diagrams of FIGS. 4A to 6B. In the operation description diagrams of FIGS. 4A to 6B, the sampling transistor 23 is illustrated with a switch symbol to facilitate the drawings.

Figure 3:
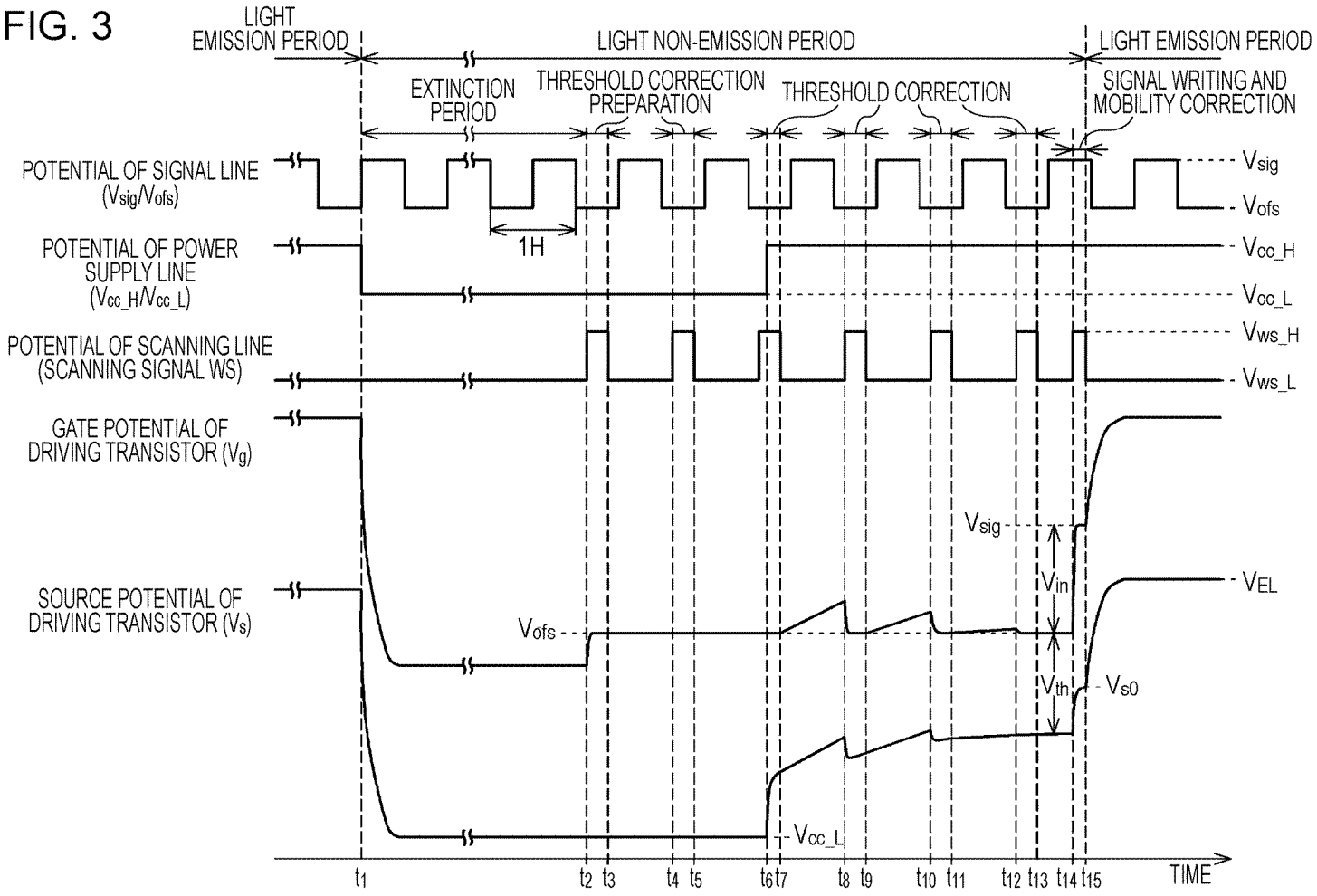
FIG. 3 is a timing chart for describing a basic circuit operation of an active matrix type organic EL display device to which a technology of the present disclosure is applied.

The timing waveform diagram of FIG. 3 illustrates a change in each of the potential (writing scanning signal) WS of the scanning line 31, the potential (power potential) DS of the power supply line 32, the potential ($V_{sig}/V_{ofs}$) of the signal line 33, and a gate potential $V_g$ and a source potential $V_s$ of the driving transistor 22. Here, a switching period of the potential of the signal line 33, i.e., a switching period of the signal voltage $V_{sig}$ and the reference voltage $V_{ofs}$ of the video signal, is one horizontal period (1H).

Since the sampling transistor 23 is an N channel transistor, a high potential state and a low potential state of the writing scanning signal WS are an active state and an inactive state, respectively. The sampling transistor 23 enters a conductive state in the active (high active) state of the writing scanning signal WS and enters a non-conductive state in the inactive state.

Light Emission Period of Previous Display Frame

In the timing waveform diagram of FIG. 3, a period before a time $t_1$ is a light emission period of the organic EL element 21 in a previous display frame. During the light emission period of the previous display frame, the potential DS of the power supply line 32 is the first power potential (hereinafter referred to as a "high potential") $V_{cc_H}$ and the sampling transistor 23 is in the non-conductive state.

Figure 4A:
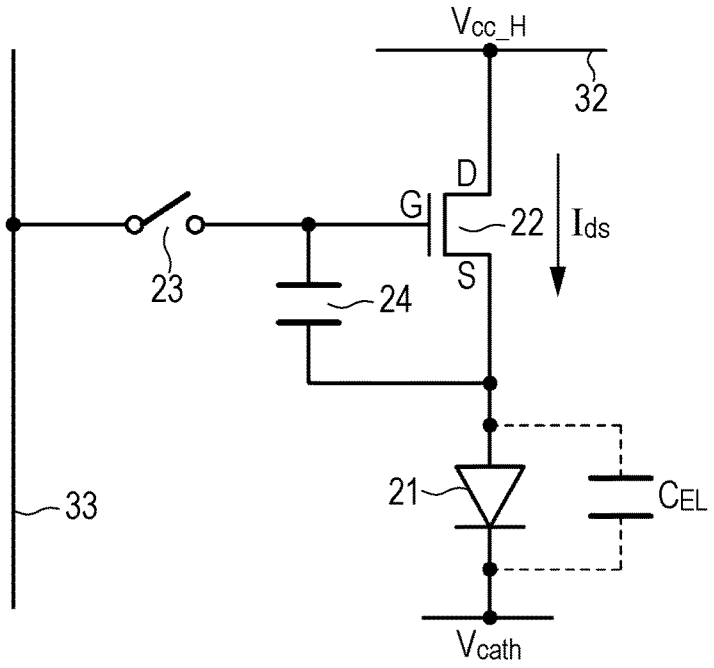
FIG. 4A is an operation description diagram during a light emission period of a previous display frame.

At this time, the driving transistor 22 is set to operate in a saturation region. Thus, as illustrated in FIG. 4A, a driving current (current between a drain and a source) $I_{ds}$ according to a gate-source voltage $V_{gs}$ of the driving transistor 22 is supplied from the power supply line 32 to the organic EL element 21 via the driving transistor 22. Accordingly, the organic EL element 21 emits light with luminance according to the current value of the driving current $I_{ds}$.

The driving current (the drain-source current of the driving transistor 22) $I_{ds}$ supplied to the organic EL element 21 is given as in expression (1) below:

$$I_{ds}=(1/2)\cdot u(W/L)C_{ox}(V_{gs}-V_{th})^2 \quad (1),$$

where W is the channel width of the driving transistor 22, L is the channel length of the driving transistor 22, and $C_{ox}$ is the gate capacitance per unit area of the driving transistor 22.

Extinction Period

Figure 4B:
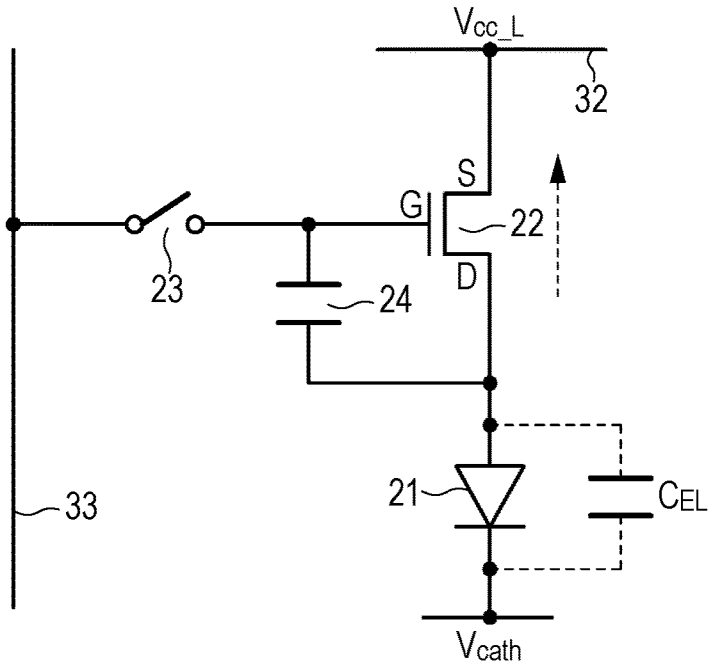
FIG. 4B is an operation description diagram during an extinction period.

When the time $t_1$ comes, a period enters a light non-emission period of a new display frame (current display frame) of the line sequential scanning. Then, as illustrated in FIG. 4B, at the time $t_1$, the potential DS of the power supply line 32 is switched from the high potential $V_{cc_H}$ to the second power potential (hereinafter referred to as a "low potential") $V_{cc_L}$.

Here, $V_{th_EL}$ is assumed to be a threshold voltage of the organic EL element 21 and $V_{cath}$ is assumed to be the potential (cathode potential) of the common power line 34. At this time, when the low potential $V_{cc_L}$ is set to satisfy "$V_{cc_L}<V_{th_EL}+V_{cath}$," the organic EL element 21 enters a reverse bias state, and thus becomes extinct. The source or drain region of the driving transistor 22 on the side of the power supply line 32 becomes the source region and the source or drain region thereof on the side of the organic EL element 21 becomes the drain region. At this time, the anode electrode of the organic EL element 21 is charged with the low potential $V_{cc_L}$.

Threshold Correction Preparation Period

Figure 5A:
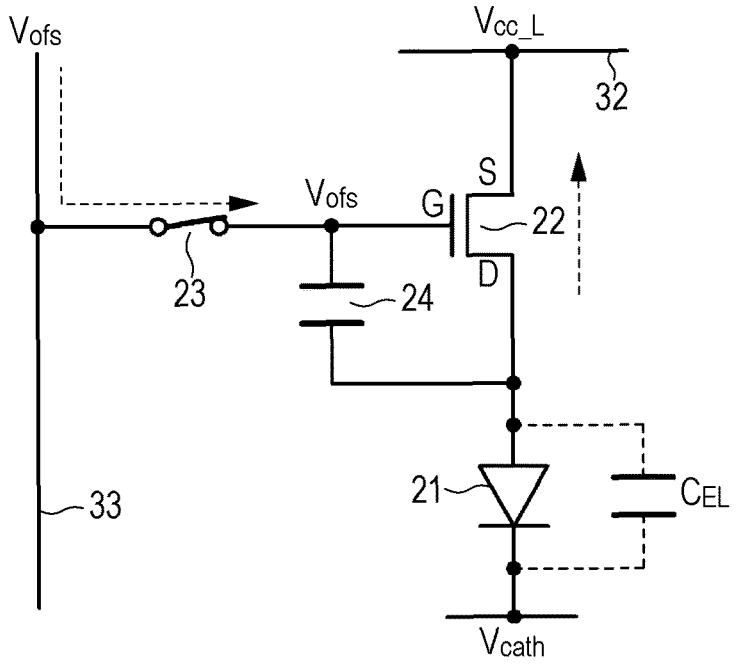
FIG. 5A is an operation description diagram during a threshold correction preparation period.

Next, when the reference voltage $V_{ofs}$ is supplied to the signal line 33 and the potential WS of the scanning line 31 transitions from a low potential $V_{ws_L}$ to a high potential $V_{ws_H}$ at a time $t_2$, the sampling transistor 23 enters a conductive state and samples the reference voltage $V_{ofs}$, as illustrated in FIG. 5A. Thus, the gate potential $V_g$ of the driving transistor 22 becomes the reference voltage $V_{ofs}$. The source potential $V_s$ of the driving transistor 22 is a potential sufficiently lower than the reference voltage $V_{ofs}$, i.e., the low potential $V_{cc_L}$.

At this time, the gate-source voltage $V_{gs}$ of the driving transistor 22 becomes $V_{ofs}-V_{cc_L}$. Here, when $V_{ofs}-V_{cc_L}$ is not greater than the threshold voltage $V_{th}$ of the driving transistor 22, a threshold correction process (threshold correction operation) to be described below may not be performed. Therefore, it is necessary to set a potential relation satisfying "$V_{ofs}-V_{cc_L}>V_{th}$."

Thus, an initialization process of setting the gate potential $V_g$ of the driving transistor 22 to the reference voltage $V_{ofs}$ and setting (defining) the source potential $V_s$ to the low potential $V_{cc_L}$ is a preparation (threshold correction preparation) process performed before the threshold correction process to be described below. Accordingly, the reference voltage $V_{ofs}$ and the low potential $V_{cc_L}$ become the initial potentials of the gate potential $V_g$ and the source potential $V_s$ of the driving transistor 22.

Thus, during a period from the time $t_2$ to a time $t_3$ in which the potential WS of the scanning line 31 is the high potential $V_{ws_H}$, a first threshold correction preparation operation is performed. Then, during a period from a time $t_4$ to a time $t_5$ of one subsequent horizontal period, a second threshold correction preparation operation is performed as in the first threshold correction preparation operation.

Threshold Correction Period

Figure 5B:
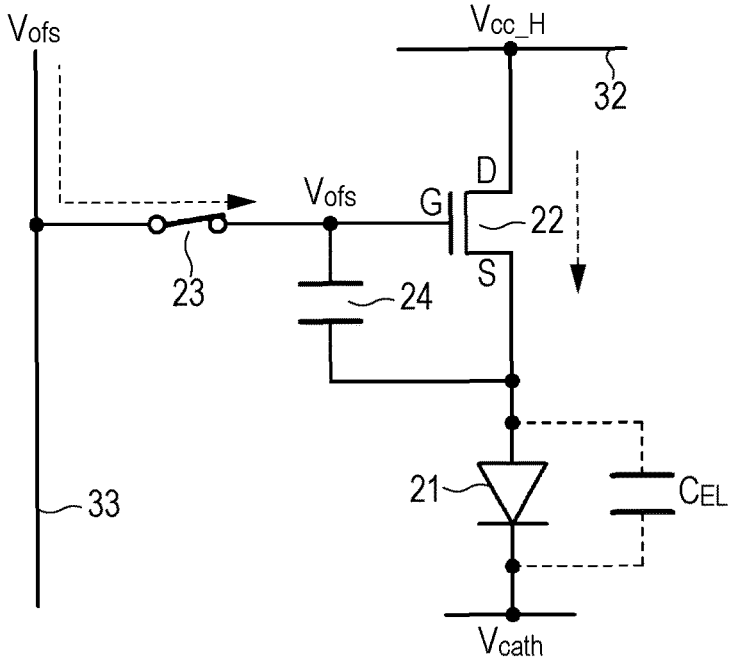
FIG. 5B is an operation description diagram during a threshold correction period.

Subsequently, during a period in which the potential of the signal line 33 is the reference voltage $V_{ofs}$ and the potential WS of the scanning line 31 is the high potential $V_{ws_H}$, the potential DS of the power supply line 32 is switched from the low potential $V_{cc_L}$ to the high potential $V_{cc_H}$ at a time $t_6$. Thus, the source or drain region of the driving transistor 22 on the side of the power supply line 32 becomes the drain region and the source or drain region thereof on the side of the organic EL element 21 becomes the source region, and thus a current flows in the driving transistor 22, as illustrated in FIG. 5B.

The equivalent circuit of the organic EL element 21 is expressed by a diode and equivalent capacitance $C_{EL}$. Accordingly, as long as the source potential $V_s$ of the driving transistor 22 satisfies "$V_s \leq V_{th_EL}+V_{cath}$ (where a leakage current of the organic EL element 21 is sufficiently smaller than the current flowing in the driving transistor 22), the current flowing in the driving transistor 22 is used to charge the holding capacitor 24 and the equivalent capacitance $C_{EL}$ of the organic EL element 21. At this time, the source potential $V_s$ of the driving transistor 22 gradually increases over time, as illustrated in the timing waveform diagram of FIG. 3.

When a given time passes, the potential WS of the scanning line 31 transitions from the high potential $V_{ws_H}$ to the low potential $V_{cc_L}$ at a time $t_7$, so that the sampling transistor 23 enters the non-conductive state. At this time, since the gate-source voltage $V_{gs}$ of the driving transistor 22 is greater than the threshold voltage $V_{th}$, the current flows in the driving transistor 22. As illustrated in the timing waveform diagram of FIG. 3, both of the gate potential $V_g$ and the source potential $V_s$ of the driving transistor 22 gradually increase.

Thus, a process (operation) of varying the source potential $V_s$ toward a potential obtained by reducing the threshold voltage $V_{th}$ of the driving transistor 22 from an initialization potential $V_{ofs}$ of the gate potential $V_g$ of the driving transistor 22 using the initialization potential $V_{ofs}$ as a reference is a threshold correction process (operation). At this time, as long as "$V_s \leq V_{th_EL}+V_{cath}$" is satisfied, a reverse bias is applied to the organic EL element 21, and thus no light is emitted.

During one subsequent horizontal period in which the potential of the signal line 33 becomes the reference voltage $V_{ofs}$ again, the potential WS of the scanning line 31 transitions to the high potential $V_{ws_H}$ again at a time $t_8$, so that the sampling transistor 23 enters the conductive state, and thus a second threshold correction process starts. The second threshold correction process is performed up to a time $t_9$ at which the potential WS of the scanning line 31 transitions to the low potential $V_{ws_L}$.

By repeating the foregoing operations, the gate-source voltage $V_{gs}$ of the driving transistor 22 finally converges into the threshold voltage $V_{th}$ of the driving transistor 22. The voltage corresponding to the threshold voltage $V_{th}$ is held in the holding capacitor 24. At this time, "$V_s=V_{ofs}-V_{th} \leq V_{th_EL}+V_{cath}$" is satisfied.

In this example, a driving method of performing so-called division threshold correction in which the threshold correction process is performed a plurality of times in a division manner is adopted. However, an embodiment of the present disclosure is not limited to the adoption of the driving method of the division threshold correction. Of course, a driving method of performing the threshold correction process only once may be adopted. Here, the "division threshold correction" refers to a driving method of separately performing the threshold correction process a plurality of times over a plurality of horizontal periods prior to one horizontal period in addition to the one horizontal period in which the threshold correction process is performed along with a signal writing and mobility correction process to be described below.

According to the driving method of the division threshold correction, even when a time allocated as one horizontal period is shortened due to an increase in the number of pixels in accordance with high resolution, a sufficiently long time can be ensured as a threshold correction period over a plurality of horizontal periods. Accordingly, even when the time allocated as one horizontal period is shortened, the sufficient time can be ensured as the threshold correction period. Therefore, the threshold correction process can be reliably performed.

In this example, under the driving method of the division threshold correction, the threshold correction process is performed a total of four times by further performing the threshold correction process twice in addition to the first and second threshold correction processes. That is, during two horizontal periods subsequent to the second horizontal period, third and fourth threshold correction processes are performed sequentially in synchronization with timings at which the potential WS of the scanning line 31 transitions from the low potential $V_{cc_L}$ to the high potential $V_{ws_H}$. Specifically, the third threshold correction process is performed during a period from a time $t_{10}$ to a time $t_{11}$ and the fourth threshold correction process is performed during a period from a time $t_{12}$ to a time $t_{13}$.

Signal Writing and Mobility Correction Period

Figure 6A:
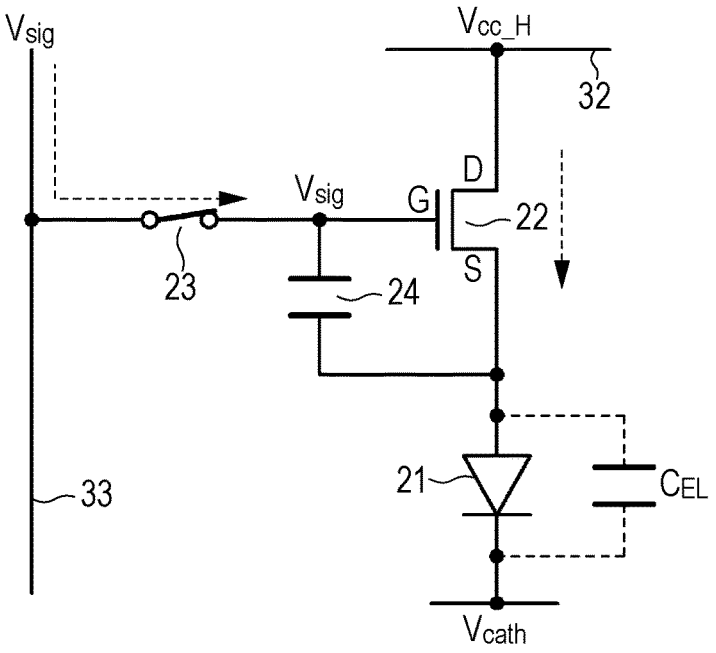
FIG. 6A is an operation description diagram during a signal writing and mobility correction period.
Figure 6B:
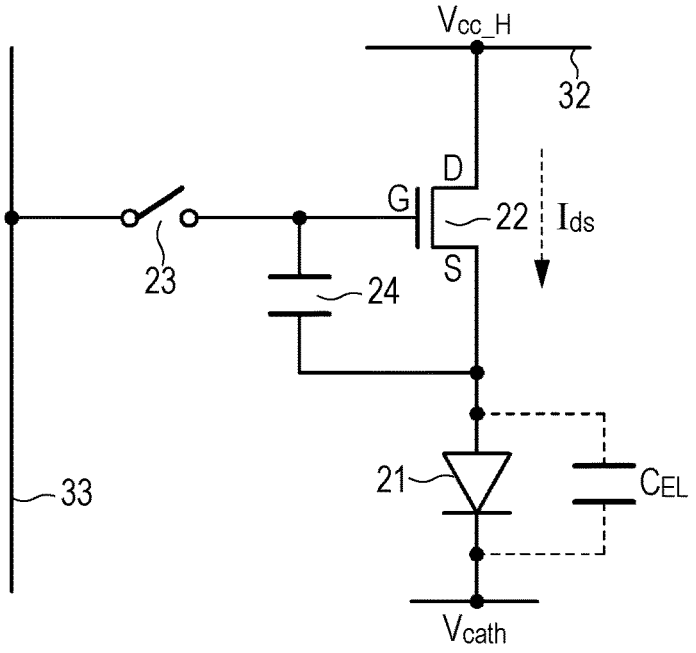
FIG. 6B is an operation description diagram during a light emission period of a current display frame.

When the fourth threshold correction process ends, a signal writing and mobility correction process is performed by switching the potential of the signal line 33 from the reference voltage $V_{ofs}$ to the signal voltage $V_{sig}$ of the video signal during the same horizontal period. That is, during a period in which the signal voltage $V_{sig}$ of the video signal is supplied to the signal line 33, the potential WS of the scanning line 31 transitions from the low potential $V_{cc_L}$ to the high potential $V_{ws_H}$ at a time $t_{14}$, so that the sampling transistor 23 enters the conductive state, as illustrated in FIG. 6A, and samples the signal voltage $V_{sig}$ to write the signal voltage $V_{sig}$ on the pixel 20.

When the sampling transistor 23 writes the signal voltage $V_{sig}$, the gate potential $V_g$ of the driving transistor 22 becomes the signal voltage $V_{sig}$. Then, when the driving transistor 22 is driven by the signal voltage $V_{sig}$ of the video signal, the threshold correction process is finally performed by offsetting the threshold voltage $V_{th}$ of driving transistor 22 by a voltage corresponding to the threshold voltage $V_{th}$ held in the holding capacitor 24.

As illustrated in the timing waveform diagram of FIG. 3, the source potential $V_s$ of the driving transistor 22 gradually increases over time. At this time, when the source potential $V_s$ of the driving transistor 22 does not exceed a sum of the cathode potential $V_{cath}$ and the threshold voltage $V_{th_EL}$ of the organic EL element 21, that is, when the leakage current of the organic EL element 21 is sufficiently smaller than the current flowing in the driving transistor 22, the current flowing in the driving transistor 22 flows in the holding capacitor 24 and the equivalent capacitance $C_{EL}$. Thus, the holding capacitor 24 and the equivalent capacitance $C_{EL}$ start to be charged.

By charging the holding capacitor 24 and the equivalent capacitance $C_{EL}$, the source potential $V_s$ of the driving transistor 22 gradually increases over time. At this time, since the correction process (correction operation) of correcting the threshold voltage $V_{th}$ of the driving transistor 22 has already been completed, the drain-source current $I_{ds}$ of the driving transistor 22 depends on mobility u of the driving transistor 22. Further, the mobility u of the driving transistor 22 is mobility of a semiconductor thin film forming a channel of the driving transistor 22.

Here, a ratio of a holding voltage $V_{gs}$ of the holding capacitor 24 to the signal voltage $V_{sig}$ of the video signal, i.e., a writing gain G, is assumed to be 1 (ideal value). Then, when the source potential $V_s$ of the driving transistor 22 increases up to the potential of "$V_{ofs}-V_{th}+\Delta V$," the gate-source voltage $V_{gs}$ of the driving transistor 22 becomes "$V_{sig}-V_{ofs}+V_{th}-\Delta V$."

That is, an increased amount $\Delta V$ of the source potential $V_s$ of the driving transistor 22 is subtracted from the voltage ($V_{sig}-V_{ofs}+V_{th}$) held in the holding capacitor 24, that is, the charge charged in the holding capacitor 24 is operated to be discharged. In other words, the increase amount $\Delta V$ of the source potential $V_s$ is an amount obtained by applying negative feedback to the holding capacitor 24. Accordingly, the increase amount $\Delta V$ of the source potential $V_s$ becomes a feedback amount of the negative feedback.

Thus, by applying the negative feedback to the gate-source voltage $V_{gs}$ by the feedback amount $\Delta V$ according to the drain-source current $I_{ds}$ flowing in the driving transistor 22, it is possible to negate dependency on the mobility u of the drain-source current $I_{ds}$ of the driving transistor 22. The process of negating the dependency is a mobility correction process (operation) of correcting a variation in the mobility u of the driving transistor 22 for each pixel.

More specifically, the higher a signal amplitude $V_{in}$ ($=V_{sig}-V_{ofs}$) of the video signal written on the gate electrode of the driving transistor 22 is, the larger the drain-source current $I_{ds}$ is. Therefore, the absolute value of the feedback amount $\Delta V$ of the negative feedback also increases. Accordingly, the mobility correction process is performed according to a light emission luminance level.

When the signal amplitude $V_{in}$ of the video signal is constant, the larger the mobility u of the driving transistor 22 is, the larger the absolute value of the feedback amount $\Delta V$ of the negative feedback is. Therefore, it is possible to remove the variation in the mobility u for each pixel. Accordingly, the feedback amount $\Delta V$ of the negative feedback can be said to be a correction amount of the mobility correction process.

Specifically, in the driving transistor 22 in which the mobility u is large, a current amount at this time is large and the source potential $V_s$ increases rapidly. In contrast, in the driving transistor 22 in which the mobility u is small at this time, a current amount is small and the source potential $V_s$ increases slowly. Thus, when the sampling transistor 23 enters the conductive state, and then the source potential $V_s$ of the driving transistor 22 increases and the sampling transistor 23 enters the non-conductive state, a voltage $V_{s0}$ to which the mobility u is reflected is achieved. A drain-source voltage $V_{ds}$ of the driving transistor 22 becomes "$V_{sig}-V_{s0}$ and is a voltage used to correct the mobility u.

Light Emission Period

When the potential WS of the scanning line 31 transitions from the high potential $V_{ws_H}$ to the low potential $V_{cc_L}$ at a time $t_{15}$, as illustrated in FIG. 6A, the sampling transistor 23 enters the non-conductive state and the signal writing and mobility correction process ends. When the sampling transistor 23 enters the non-conductive state, the gate electrode of the driving transistor 22 is electrically disconnected from the signal line 33, and thus enters a floating state.

Here, when the gate electrode of the driving transistor 22 is in the floating state, the holding capacitor 24 is connected between the gate and the source of the driving transistor 22, and thus the gate potential $V_g$ also varies in association with the variation in the source potential $V_s$ of the driving transistor 22. Accordingly, the drain-source voltage $V_{ds}$ of the driving transistor 22 remains constant.

Thus, an operation of varying the gate potential $V_g$ of the driving transistor 22 in association with the variation in the source potential $V_s$, in other words, an operation of increasing the gate potential $V_g$ and the source potential $V_s$ with the gate-source voltage $V_{ds}$ held in the holding capacitor 24 kept constant, is a bootstrap operation.

When the gate electrode of the driving transistor 22 enters the floating state and the drain-source current $I_{ds}$ of the driving transistor 22 simultaneously starts flowing in the organic EL element 21, the anode potential of the organic EL element 21 increases according to the current $I_{ds}$.

When the anode potential of the organic EL element 21 exceeds "$V_{th_EL}+V_{cath}$," the driving current starts to flow in the organic EL element 21, and thus the organic EL element 21 starts to emit light. The increase in the anode potential of the organic EL element 21 is not different from the increase in the source potential $V_s$ of the driving transistor 22. When the source potential $V_s$ of the driving transistor 22 increases, the gate potential $V_g$ of the driving transistor 22 also increases in association with the increase through the bootstrap operation accompanied in the holding capacitor 24.

At this time, when a bootstrap gain is assumed to be 1 (ideal value), an increase amount of the gate potential $V_g$ of the driving transistor 22 is the same as the increase amount of the source potential $V_s$. Therefore, during the light emission period, the gate-source voltage $V_{ds}$ of the driving transistor 22 is kept constant at "$V_{sig}-V_{ofs}+V_{th}-\Delta V$" of the driving transistor 22.

In the basic circuit operation described above, the threshold correction and the signal writing are configured to be performed during 1H (1 horizontal period). Accordingly, for example, even in a black screen display, the reference voltage $V_{ofs}$ and the signal voltage $V_{sig}$ of the video signal are rewritten for each 1H in the signal line 33.

Therefore, since the number of times charging and discharging performed in each of the signal lines $\mathbf{33}_1$ to $\mathbf{33}_n$ is great and a total of charging and discharging currents increases, the power consumption of the signal output unit 60 may increase. In other words, in the driving method according to the technology of the related art, the power consumption of signal output unit 60, and furthermore the power consumption of the display device 10, may increase due to an operation of correcting display unevenness caused due to a variation in the characteristics of elements included in the pixel 20.

When the threshold correction and the signal writing are performed during 1H, a period obtainable as a threshold correction period or a signal writing period has a given relation with the 1 horizontal period and there is constraint. The degree of freedom is low in setting of the correction period and a sufficient correction time may not be ensured in some cases. For example, when the time of the 1 horizontal period is shortened due to blunting or high-speed driving of the writing scanning signal WS or the signal voltage $V_{sig}$ of the video signal caused by an increase in the size of the display panel 70, a correction operation time (operation time) per operation may not be sufficiently ensured. In spite of the fact that the driving method of the division threshold correction described above is used, an operation for the threshold correction may not be normally performed and good uniformity may not be realized when the time of the first threshold correction period is too short.

Display Device According to Embodiments

Accordingly, a display device (organic EL display device) according to an embodiment divides one display frame period (1F) into two periods, performs the threshold correction of the driving transistor 22 during the first-half division period, and performs the signal writing during the second-half division period. The mobility correction is also performed during the same period as the period of the signal writing.

At this time, the signal output unit 60 outputs (supplies) the reference voltage $V_{ofs}$ for the threshold correction to the signal line 33 over almost the entire period of the first-half division period. That is, the potential of the signal line 33 is set to the reference voltage $V_{ofs}$ over almost the entire period of the first-half division period. Further, the signal output unit 60 outputs (supplies) the signal voltage $V_{sig}$ of the video signal for all of the lines (rows) to the signal lines 33 in sequence during the second-half division period.

As in the case of the above-described basic circuit operation, the operations are performed in the order of the threshold correction preparation→the threshold correction→the signal writing and mobility correction→the light emission→the extinction. Specifically, the operations of the threshold correction preparation→the threshold correction are performed in sequence in units of lines during the first-half division period of 1F and the operations of the signal writing and mobility correction→the light emission→the extinction are performed in sequence in units of lines during the second-half division period.

In this way, the reference voltage $V_{ofs}$ and the signal voltage $V_{sig}$ may be rewritten on the signal lines 33 for each 1F by dividing 1F into two periods, performing the threshold correction during the first-half division period, and performing the signal writing during the second-half division period. Thus, it is possible to considerably reduce the number of times the charging and discharging is performed in the signal lines $\mathbf{33}_1$ to $\mathbf{33}_n$, compared to a driving method of rewriting the reference voltage $V_{ofs}$ and the signal voltage $V_{sig}$ for each 1H.

When the case of raster display is exemplified, the charging and discharging of each of the signal lines $\mathbf{33}_1$ to $\mathbf{33}_n$ is performed for each 1H in the driving method of rewriting the reference voltage $V_{ofs}$ and the signal voltage $V_{sig}$ for each 1H. In contrast, in the organic EL display device according to the embodiment, the number of times of the charging and discharging of the signal lines $\mathbf{33}_1$ to $\mathbf{33}_n$ during one display frame is only one. Accordingly, the power consumption of the signal output unit 60 indefinitely approaches 0 [W], and thus a reduction in the signal output unit 60, and furthermore of the power consumption of the organic display device 10, can be achieved.

Since the reference voltage $V_{ofs}$ is normally written on the signal lines 33 over almost the entire period of the first-half division period, a relatively long time can be ensured freely as the threshold correction period. Thus, for example, when the time of the 1 horizontal period is shortened due to blunting or high-speed driving of the writing scanning signal WS or the signal voltage $V_{sig}$ of the video signal caused by an increase in the size of the display panel 70, a lack of the operation time which is a concern in the driving method of rewriting the reference voltage $V_{ofs}$ and the signal voltage $V_{sig}$ for each 1H is not caused. As a result, by changing only the driving timing without a change in the circuit configuration, lengthening of the threshold correction time per operation can be achieved. Therefore, good uniformity can be obtained through the operation of the sufficient threshold correction.

Hereinafter, specific embodiments of the driving method for the organic EL display device 10 according to the embodiment will be described.

First Embodiment

Figure 7:
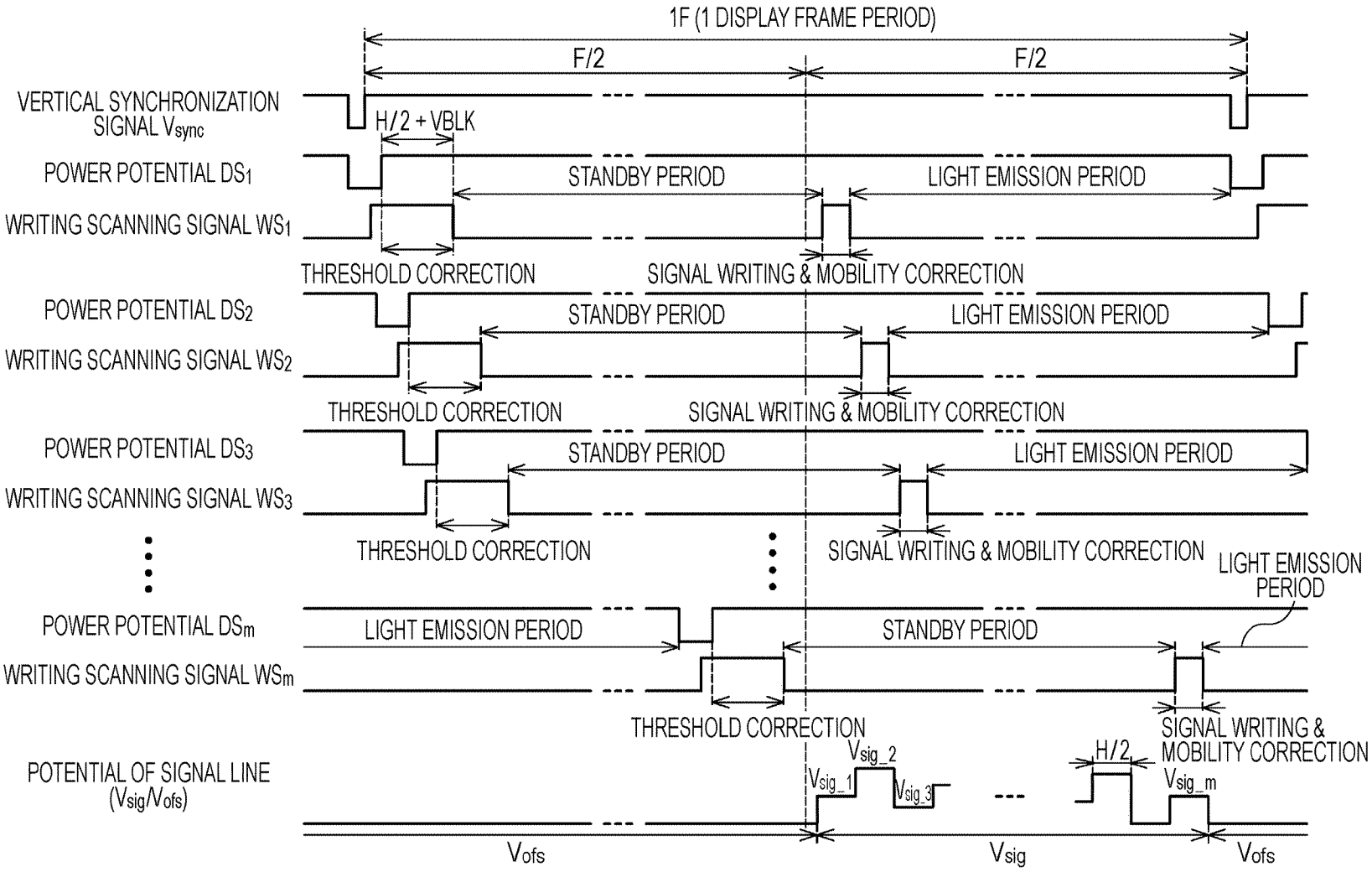
FIG. 7 is a timing chart of a driving method according to a first embodiment.
Figure 8:
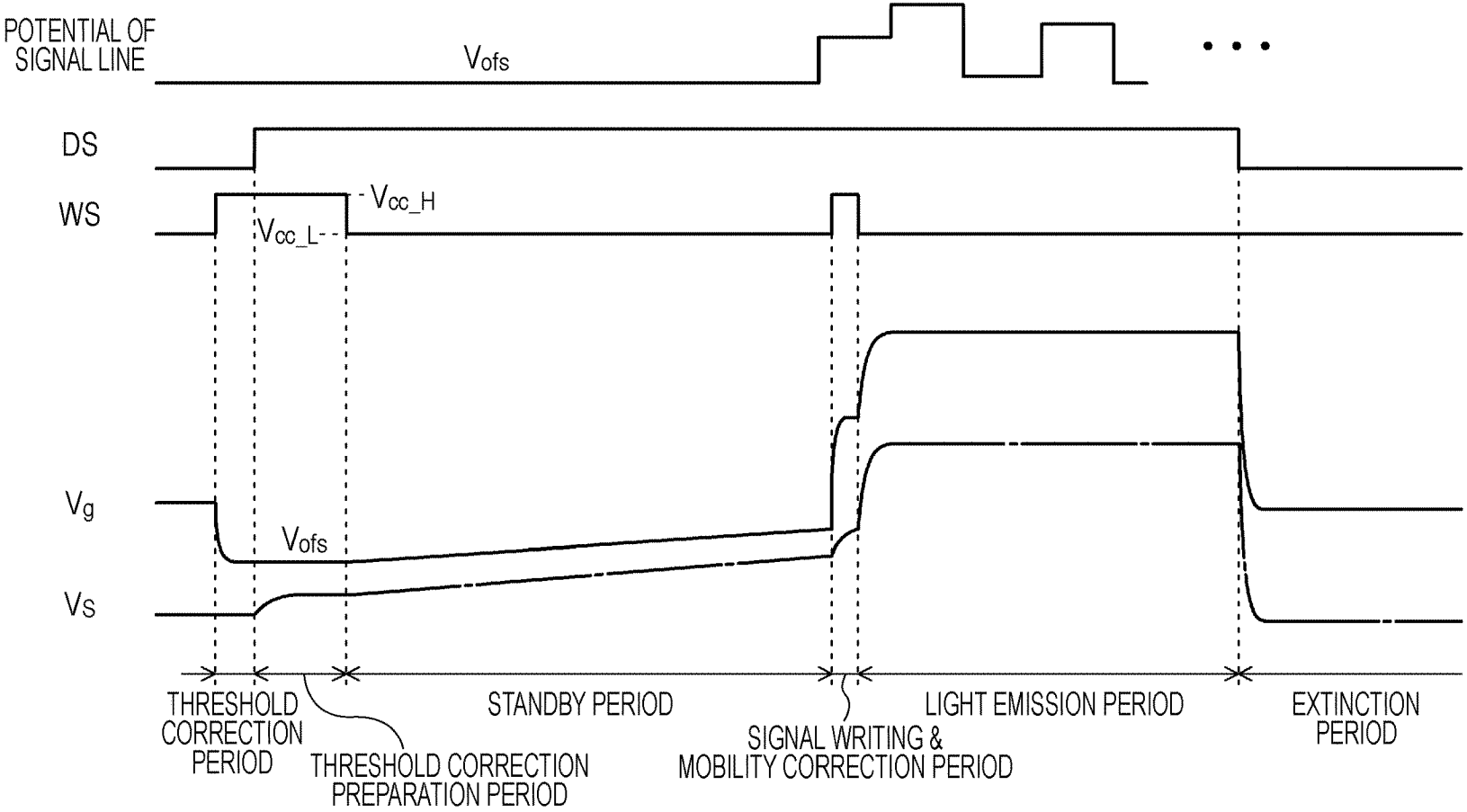
FIG. 8 is a waveform diagram illustrating a change in each of the potential of a signal line, a power potential, a writing scanning signal, and a gate potential and a source potential of a driving transistor in the case of the driving method according to the first embodiment.

FIG. 7 is a timing chart of a driving method according to a first embodiment. In the driving method according to the first embodiment, one display frame period (1F) is equally divided into two ½ frame periods, threshold correction is performed during the first-half ½ frame division period, and signal writing is performed during the second-half ½ frame division period. FIG. 8 illustrates a change in each of the potential of the signal line 33, a power potential DS, a writing scanning signal WS, and a gate potential $V_g$ and a source potential $V_s$ of the driving transistor 22. The waveform of the source potential $V_s$ is indicated in the drawing by a one-dot chain line.

A reference voltage $V_{ofs}$ is output from the signal output unit 60 to the signal line 33 over almost the entire period of the first-half ½ frame division period and the signal voltage $V_{sig}$ is output to all of the lines (rows) in sequence during the second-half ½ frame division period. As in the case of the above-described basic circuit operation, the operations are performed in the order of the threshold correction preparation→the threshold correction→the signal writing and mobility correction→the light emission→the extinction.

Specifically, the operations of the threshold correction preparation→the threshold correction are performed in sequence in units of lines during the first-half ½ frame division period. That is, the operation of the threshold correction preparation is performed during a period from a timing at which the potential (power potential) DS of the power supply line 32 transitions from the high potential $V_{ws_H}$ to the low potential $V_{cc_L}$ to a timing at which the power potential DS transitions from the low potential $V_{cc_L}$ to the high potential $V_{ws_H}$. Subsequently, the operation of the threshold correction is performed during a period from a timing at which the power potential DS transitions from the low potential $V_{cc_L}$ to the high potential $V_{ws_H}$ t to a timing at which the writing scanning signal WS transitions from the side of the high potential to the side of the low potential.

The operations of the signal writing and mobility correction→the light emission→the extinction are performed in sequence in units of lines during the second-half ½ frame division period. That is, the operation of the signal writing and mobility correction is performed during a period in which the power potential DS is in the state of the high potential $V_{ws_H}$ and the writing scanning signal WS is in the high potential state (active state). In the timing waveform diagram of FIG. 7, $V_{sig_1}$ to $V_{sig_m}$ are signal voltages of the video signal of the 1st line (row) to the m-th line and are supplied from the signal output unit 60 to the signal lines $\mathbf{33}_1$ to $\mathbf{33}_n$ in sequence at a period of H/2.

When one display frame period (1F) is divided equally into two division periods of ½ frames, only the reference voltage $V_{ofs}$ is output to the signal lines 33 during the first-half F/2 division period. Therefore, in regard to one line, the operation waits during about the ½ frame period from the threshold correction to the signal writing and mobility correction.

Thus, in the driving method of dividing one display frame period equally into two division periods of ½ frames, the reference voltage $V_{ofs}$ is output to the signal lines 33 over almost the entire period of the first-half ½ frame division period. Therefore, the threshold correction time can be ensured relatively freely within the division period of the ½ frame. Specifically, "an H/2 period+a vertical blanking (VBLK) period" can be used as a threshold correction period. That is, in the threshold correction time per operation in the driving method of performing the threshold correction and the signal writing during the 1H period, a correction period can be ensured additionally by the vertical blanking (VBLK) period.

Thus, by changing only the driving timing without a change in the circuit configuration, lengthening of the threshold correction time per operation can be achieved.

Therefore, good uniformity of a display screen can be obtained through the operation of the sufficient threshold correction. Further, in the signal writing and mobility correction, the operation is performed during the H/2 period as in the case of the above-described basic circuit operation.

In the driving method according to the first embodiment, the time of a standby period from the threshold correction operation to the signal writing and mobility correction operation can be made constant in each line. Thus, since a minute leakage current of the driving transistor 22 occurring during the standby period is constant in each line, vertical shading can be prevented from occurring.

As the characteristics of the driving method according to the above-described first embodiment, there is the standby period between the threshold correction and the mobility correction. This is because it is necessary to wait for only a period corresponding to about the ½ frame from the threshold correction to the mobility correction since only the reference voltage $V_{ofs}$ is output to the signal lines 33 during the first-half ½ frame period, as is apparent from the timing waveform diagram of FIG. 7.

Figure 9:
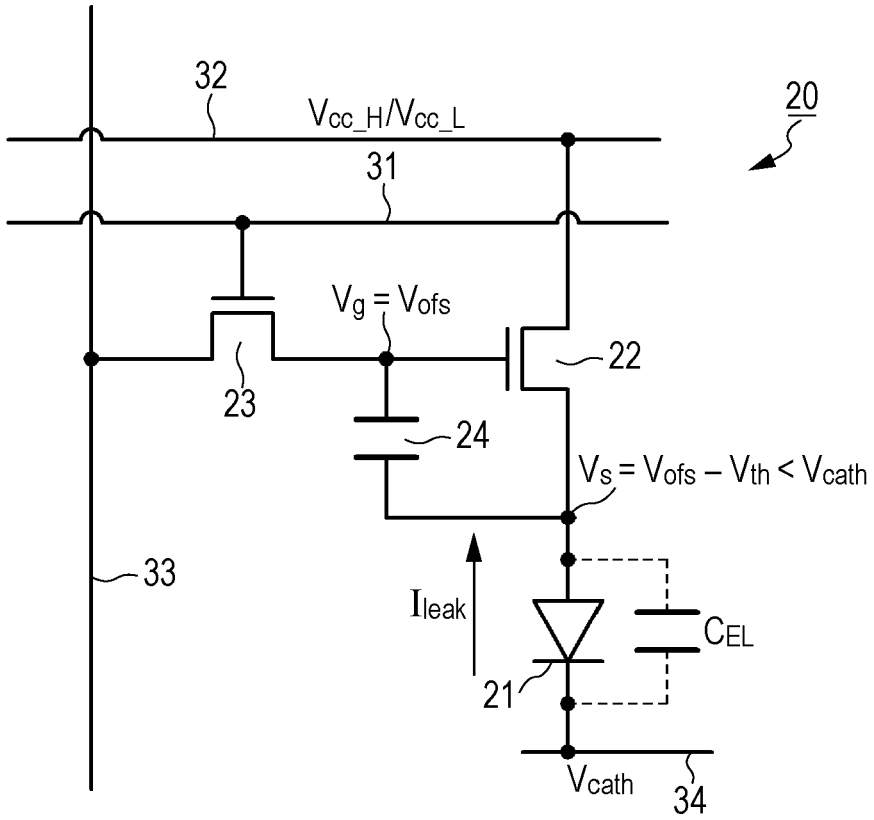
FIG. 9 is a diagram for describing an operation point during a standby period after threshold correction and a leakage current flowing in a source electrode of the driving transistor.

Here, an operation point during the standby period of about the ½ frame from the threshold correction to the mobility correction will be considered. During the standby time, a reverse-direction voltage (reverse bias voltage) is applied to the organic EL element 21. However, as illustrated in FIG. 9, in a precise sense, a leakage current $I_{leak}$ flows. The leakage current $I_{leak}$ flows in the source electrode of the driving transistor 22. As illustrated in the waveform diagram of FIG. 8, the source potential $V_s$ of the driving transistor 22 increases during the standby time due to the influence of the leakage current $I_{leak}$.

At this time, the sampling transistor 23 is in the non-conductive state and the gate electrode of the driving transistor 22 is in the floating state. Further, the gate potential $V_g$ of the driving transistor 22 follows the source potential $V_s$ and also increases due to the capacitance coupling by the holding capacitor 24. Thus, the gate potential $V_g$ of the driving transistor 22 immediately before writing of the signal voltage $V_{sig}$ of the video signal becomes a higher potential than a desired potential ($=V_{ofs}$). Accordingly, since an effective signal voltage $V_{in}$ written on the gate electrode of the driving transistor 22 is compressed by the increased amount of the gate potential $V_g$, a desired luminance may not be obtained. Here, the desired luminance refers to luminance corresponding to the signal voltage $V_{sig}$ of the video signal written on the gate electrode of the driving transistor 22.

Accordingly, in the embodiment, to obtain the desired luminance by preventing the source potential $V_s$ of the driving transistor 22 from increasing due to the influence of the leakage current $I_{leak}$ during the standby period, a light-emitting portion has a multi-layer structure formed by stacking at least two electro-optic elements (light-emitting elements). In the organic EL display device 10 according to the embodiment, a structure formed by using the organic EL elements as the electro-optic elements forming the light-emitting portion and stacking the plurality of organic EL elements is realized.

Second Embodiment

Hereinafter, a specific embodiment (second embodiment) of a light-emitting portion in the organic EL display device 10 according to the embodiment will be described. Further, the organic EL element forming the light-emitting portion basically has a configuration in which an organic layer including a light-emitting layer is provided between a first electrode (for example, an anode electrode) and a second electrode (for example, a cathode electrode) and light is emitted when electrons and holes are recombined in the light-emitting layer by applying a direct-current voltage between the first and second electrodes.

Figure 10A:
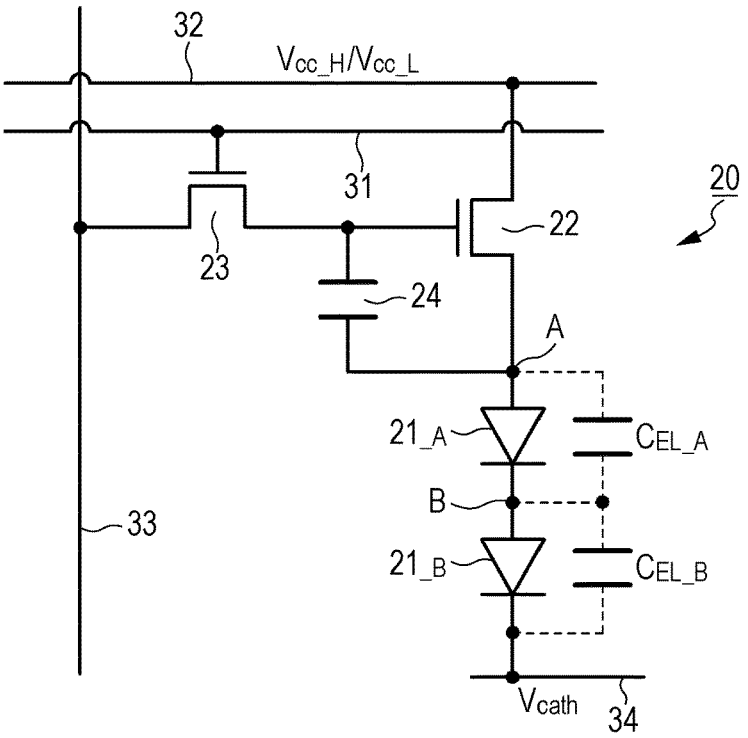
FIG. 10A is an equivalent circuit diagram illustrating a pixel circuit including a light-emitting portion according to a second embodiment in the organic EL display device according to an embodiment.

FIG. 10A is an equivalent circuit diagram illustrating a pixel circuit including the light-emitting portion according to the second embodiment in the organic EL display device 10 according to the embodiment. As illustrated in FIG. 10A, the light-emitting portion according to the second embodiment has a two-layer structure in which two organic EL elements $\mathbf{21}_{_A}$ and $\mathbf{21}_{_B}$ are stacked. The anode electrode of the organic EL element $\mathbf{21}_{_A}$ is connected to one source or drain electrode of the driving transistor 22 and the cathode electrode of the organic EL element $\mathbf{21}_{_B}$ is connected to the common power line 34 which is a node of the reference potential (cathode potential $V_{cath}$). Here, the equivalent capacitance of the organic EL element $\mathbf{21}_{_A}$ is referred to as $C_{EL_A}$ and the equivalent capacitance of the organic EL element $\mathbf{21}_{_B}$ is referred to as $C_{EL_B}$.

Figure 10B:
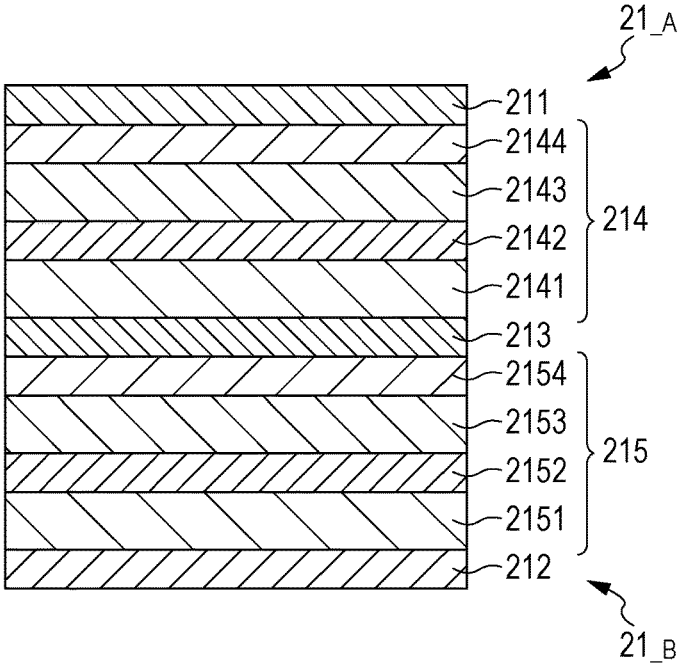
FIG. 10B is a diagram illustrating a sectional configuration of the light-emitting portion according to the second embodiment.

FIG. 10B illustrates an example of the cross-sectional configuration of the light-emitting portion according to the second embodiment. In the light-emitting portion according to the second embodiment, an uppermost electrode 211 serves as the anode electrode of the organic EL element $\mathbf{21}_{_A}$ and a lowermost electrode 212 serves as the cathode electrode of the organic EL element $\mathbf{21}_{_B}$. A connection layer 213 provided between the organic EL element $\mathbf{21}_{_A}$ and the organic EL element $\mathbf{21}_{_B}$ serves as both of the cathode electrode of the organic EL element $\mathbf{21}_{_A}$ and the anode electrode of the organic EL element $\mathbf{21}_{_B}$.

An organic layer 214 of the organic EL element $\mathbf{21}_{_A}$ is formed by sequentially stacking a hole injection layer 2141, a hole transport layer 2142, a light emission layer 2143, and an electron transport layer 2144 between the connection layer 213 and the uppermost electrode 211. Likewise, an organic layer 215 of the organic EL element $\mathbf{21}_{_B}$ is formed by sequentially stacking a hole injection layer 2151, a hole transport layer 2152, a light emission layer 2153, and an electron transport layer 2154 between the lowermost electrode 212 and the connection layer 213.

Here, a node of the anode electrode of the organic EL element $\mathbf{21}_{_A}$ is referred to as a node A and a node (intermediate node) between the cathode electrode of the organic EL element $\mathbf{21}_{_A}$ and the anode electrode of the organic EL element $\mathbf{21}_{_B}$ is referred to as a node B. Further, the potentials of the nodes A and B when the light-emitting portion (organic EL element) emits light are referred to as $V_A$ and $V_B$ and threshold voltages of the organic EL elements $\mathbf{21}_{_A}$ and $\mathbf{21}_{_B}$ are referred to as $V_{th_A}$ and $V_{th_B}$.

In the light-emitting portion (organic EL element) adopting the foregoing two-layer structure, the following configuration is adopted to prevent the source potential $V_s$ of the driving transistor 22 from increasing due to the influence of the leakage current $I_{leak}$ during the standby period. The potential $V_B$ of the node B is configured to satisfy the potential relation of the following expression (2) at an extinction timing, i.e., a timing at which the power potential DS is switched from the high potential $V_{ws_H}$ to the low potential $V_{cc_L}$.

$$V_{th_B} > V_B > V_{cath} \tag{2}$$

That is, the potential $V_B$ of the node (intermediate node) B at the time of the extinction is configured to satisfy a potential relation in which the potential $V_B$ is lower than the threshold voltage $V_{th_B}$ of the organic EL element $\mathbf{21}_{_B}$ on the side of the cathode potential $V_{cath}$ which is a reference potential and is higher than the cathode potential $V_{cath}$.

Here, when the potential $V_B$ of the node (intermediate node) B at the time of the extinction is expressed as an expression, the potential $V_B$ can be expressed as follows.

$$V_B=V_{th_B}-(V_{th_A}-V_{cc_L})\times C_{EL_A}/(C_{EL_A}+C_{EL_B}) \quad (3)$$

Here, expression (3) expresses how the potential $V_B$ of the node B at the time of the extinction is determined by the equivalent capacitances $C_{EL_A}$ and $C_{EL_B}$ of the organic EL elements 21$_{_A}$ and 21$_{_B}$.

Here, when the equivalent capacitances $C_{EL_A}$ and $C_{EL_B}$ of the organic EL elements 21$_{_A}$ and 21$_{_B}$ has the relation of the following expression (4), the condition of expression (2) can be easily satisfied and thus is more preferable.

$$C_{EL_A}<C_{EL_B} \quad (4)$$

The equivalent capacitances $C_{EL_A}$ and $C_{EL_B}$ of the organic EL elements 21$_{_A}$ and 21$_{_B}$ are determined by the distance between the two facing electrodes, the areas of the electrodes, and the like. In terms of a pixel opening area, it is preferable that the electrode area is the same between the organic EL elements 21$_{_A}$ and 21$_{_B}$. Accordingly, to satisfy the relation of expression (4), the equivalent capacitances $C_{EL_A}$ and $C_{EL_B}$ may be determined according to a difference in the distance between the two facing electrodes, in this example, a difference between the film thicknesses of the organic layers 214 and 215.

In the light-emitting portion having the two-layer structure, as described above, when the potential $V_B$ of the node B at the time of the extinction satisfies the potential relation of expression (2), a forward direction voltage (forward bias voltage) is applied to the organic EL element 21$_{_B}$ on the side of the cathode potential $V_{cath}$. Therefore, the potential $V_B$ of the node B is shifted in a falling direction and the potential $V_A$ of the node A is also shifted in a decreasing direction due to the capacitance coupling of the equivalent capacitance $C_{EL_A}$ of the organic EL element 21$_{_A}$ and the holding capacitor 24.

Thus, even when the entire light-emitting portion is in the reverse bias state in which the potential $V_A$ (the source potential $V_s$ of the driving transistor 22) of the node A is lower than the cathode potential $V_{cath}$, the source potential $V_s$ of the driving transistor 22 can be prevented from increasing, and furthermore the gate potential $V_g$ can be prevented from increasing. Accordingly, since the effective signal voltage $V_{in}$ written on the gate electrode of the driving transistor 22 is not compressed, it is possible to realize display at the desired luminance corresponding to the signal voltage $V_{in}$.

Figure 11:
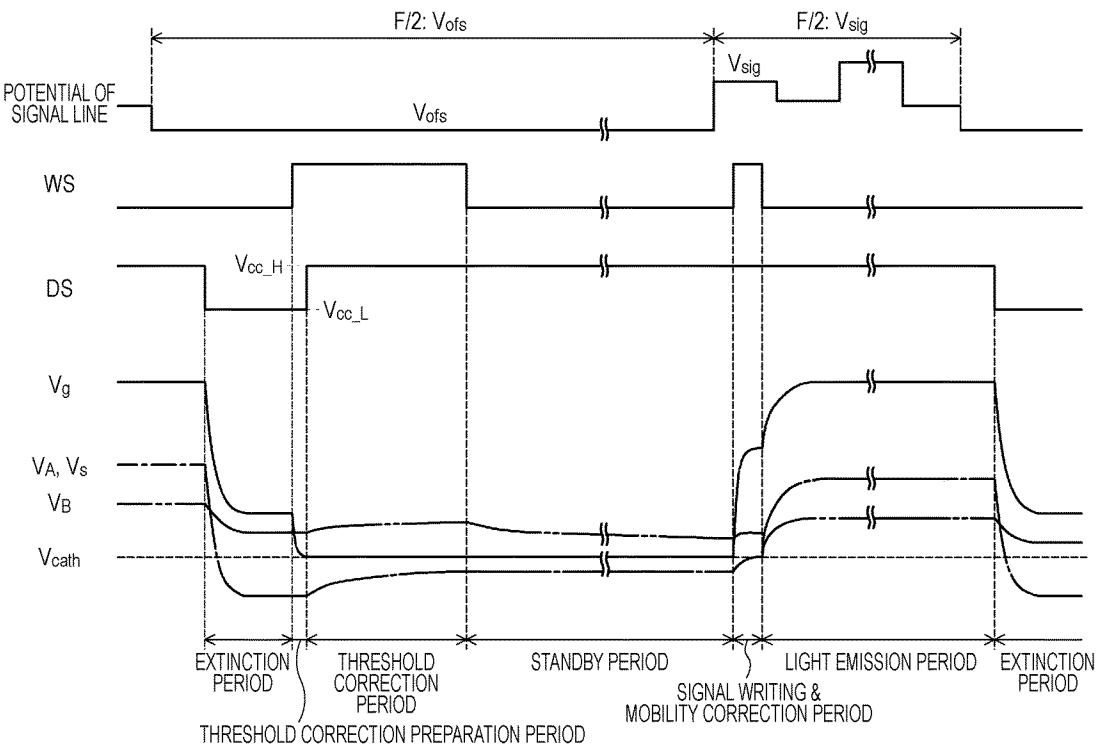
FIG. 11 is a waveform diagram illustrating a change in each of the potential of a signal line, a writing scanning signal, a power potential, a gate potential of a driving transistor, a potential $V_A$ of a node A, and a potential $V_B$ of a node B in the case of the light-emitting portion according to the second embodiment.

FIG. 11 illustrates a change in each of the potential of the signal line 33, a writing scanning signal WS, a power potential DS, and a gate potential $V_g$ of the driving transistor 22, a potential $V_A$ of the node A (a source potential $V_s$ of the driving transistor 22), and a potential $V_B$, of the node B. The waveform of the potential $V_A$ of the node A is indicated by a one-dot chain line and the waveform of the potential $V_B$ of the node B is indicated by a two-dot chain line in the drawing.

Modification Examples

The embodiments of the technology of the present disclosure have been described above, but the technology of the present disclosure is not limited to the scope described in the foregoing embodiments. That is, various modifications or improvements of the foregoing embodiments can be made within the scope of the present disclosure without departing from the gist of the technology of the present disclosure, and the modifications and improvements are included in the technical scope of the technology of the present disclosure.

For example, in the foregoing embodiments, the driving circuit driving the organic EL element 21 has a 2Tr/1C type circuit configuration formed by two transistors (22 and 23) and one capacitor element (24), but an embodiment of the present disclosure is not limited thereto. To supplement a shortage of the capacitance of the organic EL element 21 and increase a writing gain of the video signal for the holding capacitor 24, it is also possible to realize a 2Tr/2C type circuit configuration in which an auxiliary capacitor of which one electrode is connected to the anode electrode of the organic EL element 21 and the other electrode is connected to a node with a fixed potential is added, as necessary. It is also possible to realize a 3Tr/1C (2C) type circuit configuration in which a switching transistor selectively giving the reference voltage $V_{ofs}$ used for the threshold correction to the gate electrode of the driving transistor 22 is added or a circuit configuration in which one transistor or a plurality of transistors are added, as necessary.

In the foregoing embodiments, the cases in which an embodiment of the present disclosure is applied to the organic EL display device in which the organic EL element is used as the electro-optic element of the pixel 20 have been exemplified, but an embodiment of the present disclosure is not limited to the application examples. Specifically, an embodiment of the present disclosure can generally be applied to a display device in which a current driving type electro-optic element, such as an inorganic EL element, an LED element, or a semiconductor laser element, in which light emission luminance varies according to a current value flowing in the device is used.

In the foregoing embodiments, the two-layer structure of the light-emitting portion (organic EL element) in which the two organic EL elements 21$_{_A}$ and 21$_{_B}$ are stacked has been exemplified, but an embodiment of the present disclosure is not limited to the two-layer structure and a multi-layer structure with three or more layers can also be used. Even when a multi-layer structure with three or more layers is used, an intended purpose can be achieved by setting a potential relation in which the potential of an intermediate node at the time of extinction between the uppermost electrode and the lowermost electrode is lower than a threshold voltage of an electro-optic element on the side of the cathode potential $V_{cath}$ and is higher than the cathode potential $V_{cath}$.

Figure 12:
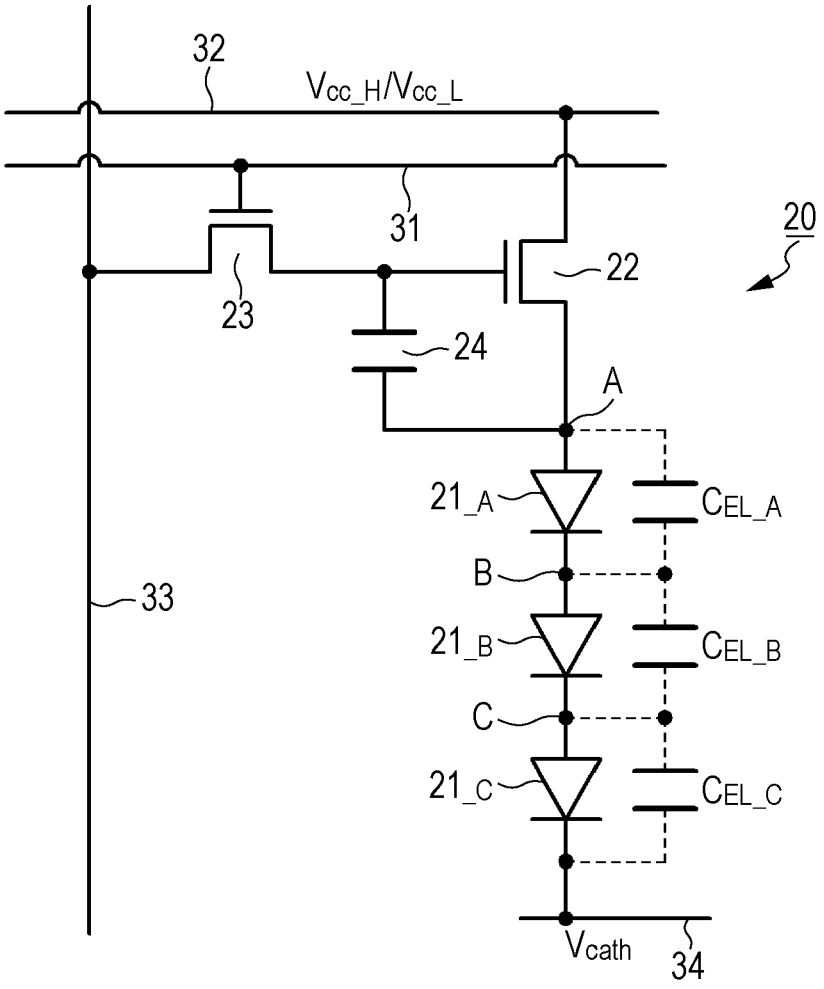
FIG. 12 is an equivalent circuit diagram illustrating a pixel circuit including a light-emitting portion with a three-layer structure.

FIG. 12 is an equivalent circuit diagram illustrating a pixel circuit including a light-emitting portion with a three-layer structure. Here, a node of the anode electrode of an organic EL element 21$_{_A}$ is referred to as a node A, a node between the cathode electrode of the organic EL element 21$_{_A}$ and the anode electrode of an organic EL element 21$_{_B}$ is referred to as a node B, and a node between the cathode electrode of the organic EL element 21$_{_B}$ and the anode electrode of an organic EL element 21$_{_C}$ is referred to as a node C. The potentials of the nodes A, B, and C when the light-emitting portion (organic EL element) emits light are referred to as $V_A$, $V_B$, and $V_C$ and threshold voltages of the organic EL elements 21$_{_A}$, 21$_{_B}$, and 21$_{_C}$ are referred to as $V_{th_A}$, $V_{th_B}$, and $V_{th_C}$.

When the above-described light-emitting portion has a three-layer structure, the potentials $V_B$, and $V_C$ of the intermediate nodes, i.e., the nodes B and C, at the time of the extinction may be set to have a potential relation in which the potentials $V_B$, and $V_C$ are lower than the threshold voltage $V_{th_C}$ of the organic EL element 21$_{_C}$ and are higher than the cathode potential $V_{cath}$. Even when all of the light-emitting portions are in the reverse bias state by this setting, it is possible to prevent the source potential $V_s$ of the driving transistor 22 from increasing, and furthermore the gate potential $V_g$ from increasing. Accordingly, since the effective signal voltage $V_{in}$ written on the gate electrode of the driving transistor 22 is not compressed, it is possible to realize display at the desired luminance.

In an embodiment of the present disclosure, driving methods according to modification examples (first and second modification examples) to be described below can also be adopted.

First Modification Example

In the driving method according to the first embodiment, by dividing one display frame period (1F) into two division periods, performing the threshold correction during the first-half division period, and performing the signal writing during the second-half division period, it is possible to ensure the threshold correction time relatively freely. In contrast, since the scanning speed is doubled in the signal writing and mobility correction compared to the above-described basic circuit operation and the mobility correction time is shortened, there is a concern that the correction of the mobility u is insufficient. Further, the above-described basic circuit operation refers to an operation under a driving method of performing the threshold correction and the mobility correction during a 1H period.

Figure 13:
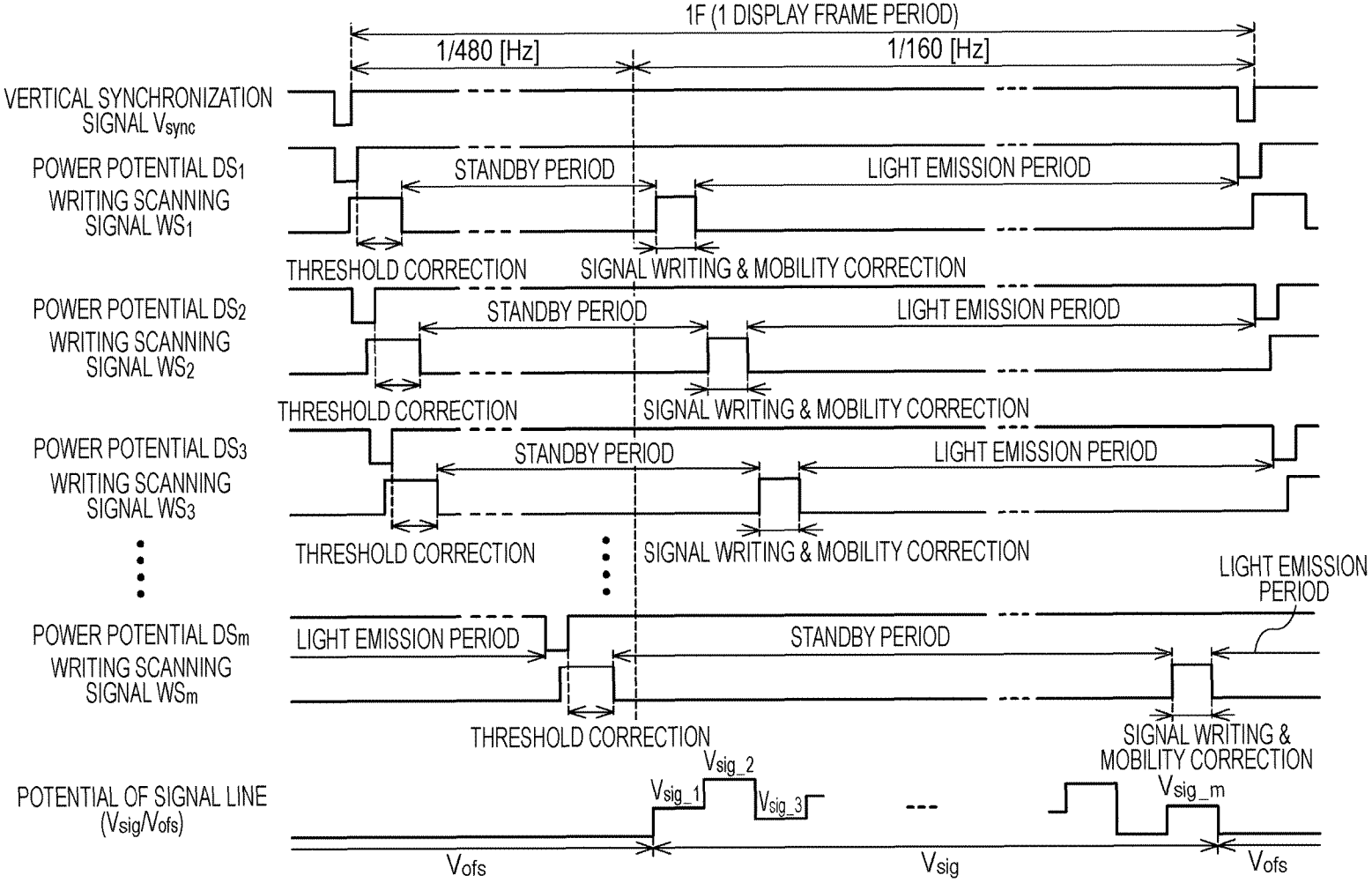
FIG. 13 is a timing chart illustrating an operation sequence in a driving method according to a first modification example.

Accordingly, in a driving method according to a first modification example, a configuration is adopted in which the threshold correction is performed during the first-half division period of 1F, the signal writing is performed in the second-half division period, and the second-half division period is set to be longer than the first-half division period. FIG. 13 illustrates an operation sequence of the driving method according to the first modification example.

In this way, by setting the second-half division period to be longer than the first-half division period and setting a scanning speed of the signal writing and mobility correction to be slower than a scanning speed of the threshold correction, it is possible to ensure a margin of an operation time of the mobility correction. Thus, since the mobility correction can be more reliably performed, a display screen with high uniformity can be obtained. In regard to the threshold correction, the threshold correction time per operation can be lengthened compared to the driving method of performing the threshold correction and the mobility correction during the 1H period. Therefore, good uniformity can be obtained through the operation of the sufficient threshold correction.

Second Modification Example

An object of the technology of the present disclosure is to resolve the problem caused due to the leakage current $I_{leak}$ occurring when the reverse bias state of the light-emitting portion continues to be lengthened. As examples of the case in which the reverse bias state of the light-emitting portion continues to be lengthened, the driving method of dividing 1F into two division periods, performing the threshold correction during the first-half division period, and performing the signal writing during the second-half division period has been exemplified as the driving methods according to the first embodiment and the first modification example. However, the driving method in an example of the case in which the reverse bias state of the light-emitting portion continues to be lengthened is not limited to the driving methods according to the first embodiment and the first modification example.

A driving method according to a second modification example can be exemplified as a driving method in another example of the case in which the reverse bias state of the light-emitting portion continues to be lengthened. In the driving method according to the second modification example, scanning periods allocated to a plurality of pixel rows (lines) are set collectively as a combined scanning period including first and second periods. Then, the threshold correction is performed concurrently on the plurality of lines during the first period and the signal voltage $V_{sig}$ is written (sampled) sequentially on the plurality of lines by the sampling transistor 23 during the second period.

Figure 14:
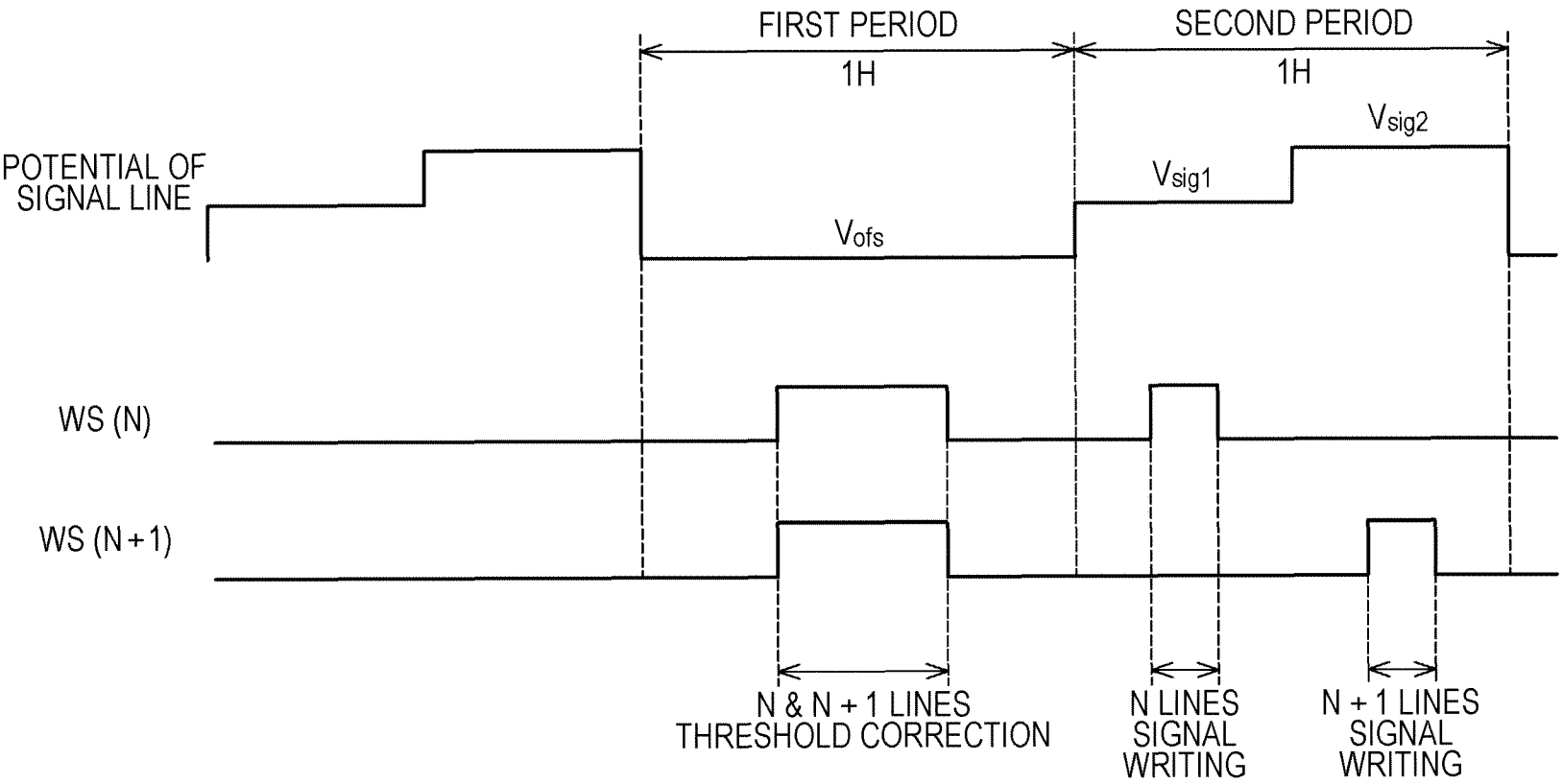
FIG. 14 is a timing chart illustrating an operation sequence in a driving method according to a second modification example.

FIG. 14 illustrates an operation sequence in the driving method according to the second modification example. In the writing scanning unit 40, the scanning periods (1H) allocated to the plurality of scanning lines (in this example, two scanning lines) are set collectively as the combined scanning period including the first and second periods. In other words, the combined scanning period corresponds to 2H. The writing scanning signal WS is output concurrently to two scanning lines (a line N and a line N+1) during the first period to perform the threshold correction operation concurrently.

Subsequently, the writing scanning signal WS is output sequentially to the two scanning lines (the line N and the line N+1) during the second period to sequentially perform the writing operation for the signal voltage $V_{sig}$. In the illustrated example, the potential of the signal line 22 is the reference voltage $V_{ofs}$ during the first period corresponding to the first half of the combined scanning period 2H and is changed sequentially from a signal voltage $V_{sig1}$ to a signal voltage $V_{sig2}$ during the second period corresponding to the second half. At this time, the sampling transistor 33 in the N-th line enters the conductive state according to the writing scanning signal WS (N) and samples the signal voltage $V_{sig1}$. Subsequently, the sampling transistor 33 in the N+1-th line enters the conductive state according to the writing scanning signal WS (N+1) and samples the signal voltage $V_{sig2}$.

As described above, in the driving method according to the second modification example, the plurality of scanning periods (horizontal periods) are combined, the threshold correction operation is performed commonly during the first half of the combined period, and thereafter the signal writing operation is performed sequentially. In the driving method according to the second modification example, the threshold correction operation and the signal writing operation can be performed normally even when one horizontal period is shortened. As a result, it is possible to correspond to the high resolution of the pixels and high speed of the driving of the active matrix type display device. Further, since the threshold correction period can be substantially lengthened, the threshold correction operation can be reliably performed, thereby obtaining uniform image quality with no unevenness.

In the case of the driving method according to the second modification example, as is apparent from FIG. 14, the times from the threshold correction operation to the signal writing operation are different between the line N and the line N+1. Specifically, the line N+1 is longer than the line N. Thus, in the line N+1 in which the time from the threshold correction operation to the signal writing operation is longer, there is a concern that the problem caused due to the above-described leakage current $I_{leak}$ occurs. Accordingly, by applying the technology of the present disclosure to the driving method according to the second modification example, it is possible to resolve the problem caused due to the leakage current $I_{leak}$. That is, the technology of the present disclosure can also be applied to the driving method according to the second modification example without limitation to the driving methods according to the first embodiment and the first modification example.

Electronic Apparatus

The display device according to the above-described embodiments of the present disclosure can be used as a display unit (display device) of an electronic apparatus in all the fields in which a video signal input to the electronic apparatus or a video signal generated in the electronic apparatus is displayed as an image or a video.

As is apparent from the description of the above-described embodiments, the display device according to an embodiment of the present disclosure is designed to reduce power consumption of an operation of correcting display unevenness caused due to a variation in the characteristics of the elements included in the pixels, and thus can obtain a display screen of high uniformity. Accordingly, by using the display device according to an embodiment of the present disclosure as a display unit of an electronic apparatus in all the fields, it is possible to contribute to the lower power consumption of the electronic apparatus and to obtain a display screen of excellent image quality.

Examples of the electronic apparatus in which the display device according to an embodiment of the present disclosure is used as a display unit include a digital camera, a video camera, a game apparatus, and a notebook-type personal computer in addition to a television system. Further, the display device according to an embodiment of the present disclosure can also be used as a display unit of an electronic apparatus such as a portable communication apparatus such as an electronic book apparatus or an electronic wristwatch or a portable communication apparatus such as a portable telephone or a PDA.

Embodiments of the present disclosure can be realized as follows.

[1] A display device includes: a sampling transistor configured to sample a signal voltage of a video signal; a holding capacitor configured to hold the signal voltage sampled by the sampling transistor; and a pixel circuit configured to include a driving transistor that drives a light-emitting portion according to the signal voltage held in the holding capacitor. The light-emitting portion is formed by stacking at least two electro-optic elements, an uppermost electrode is connected to one source or drain electrode of the driving transistor, and a lowermost electrode is connected to a node of a reference potential. A potential of an intermediate node between the uppermost electrode and the lowermost electrode at a time of extinction is set with a potential relation in which the potential of the intermediate node is lower than a threshold voltage of the electro-optic element on a side of the reference potential and is higher than the reference potential.

[2] In the display device described in [1] above, the potential of the intermediate node at the time of extinction may be determined by capacitance values of at least the two electro-optic elements.

[3] In the display device described in [2] above, the capacitance value of the electro-optic element on the side of the reference potential may be greater than the capacitance value of the electro-optic element on a side of the driving transistor.

[4] In the display device described in [3] above, the electro-optic element may include two electrodes with a light-emitting layer interposed therebetween. The capacitance values of at least the two electro-optic elements may be determined in accordance with a difference in a distance between the two electrodes.

[5] In the display device described in any one of [1]to [4] above, threshold correction of the driving transistor may be performed during a first-half division period of two division periods divided from one display frame period, and signal writing may be performed by the sampling transistor during a second-half division period.

[6] In the display device described in [5] above, the second-half division period may be set to be longer than the first-half division period.

[7] In the display device described in [5] or [6] above, an operation for the threshold correction may be performed by varying a potential of the one source or drain electrode of the driving transistor toward a potential obtained by reducing a threshold voltage of the driving transistor from an initialization potential of a gate potential of the driving transistor using the initialization potential as a reference.

[8] In the display device described in [7] above, during the first-half division period, a reference voltage determining the initialization potential of the driving transistor may be applied to the gate electrode of the driving transistor.

[9] In the display device described in [8] above, the reference voltage may be supplied to a signal line supplied with the signal voltage of the video signal at a different timing from the signal voltage. The sampling transistor may apply the reference voltage to the gate electrode of the driving transistor by sampling the reference voltage supplied to the signal line.

[10] In the display device described in any one of [5]to [9] above, during the second-half division period, mobility correction of the driving transistor may be performed.

[11] In the display device described in [10] above, an operation for the mobility correction may be performed by applying negative feedback to the holding capacitor by a feedback amount in accordance with a current flowing in the driving transistor.

[12] In the display device described in any one of [1]to [4] above, scanning periods allocated to a plurality of pixel rows may be set collectively as a combined scanning period including first and second periods, threshold correction may be performed concurrently on the plurality of pixel rows during the first period, and the signal voltage may be sampled by the sampling transistor sequentially on the plurality of pixel rows during the second period.

[13] In the display device described in [12] above, an operation for the threshold correction may be performed by varying a potential of the one source or drain electrode of the driving transistor toward a potential obtained by reducing a threshold voltage of the driving transistor from an initialization potential of a gate potential of the driving transistor using the initialization potential as a reference.

[14] In the display device described in [12] or [13]above, an operation for mobility correction may be performed by applying negative feedback to the holding capacitor by a feedback amount in accordance with a current flowing in the driving transistor during a period in which the signal voltage of the video signal is sampled by the sampling transistor.

[15] In the display device described in any one of [1]to [14] above, the electro-optic element forming the light-emitting portion may be an organic electro-luminescence element.

[16] An electronic apparatus includes a display device including a sampling transistor configured to sample a signal voltage of a video signal, a holding capacitor configured to hold the signal voltage sampled by the sampling transistor, and a pixel circuit configured to include a driving transistor that drives a light-emitting portion according to the signal voltage held in the holding capacitor. The light-emitting portion is formed by stacking at least two electro-optic elements, an uppermost electrode is connected to one source or drain electrode of the driving transistor, and a lowermost electrode is connected to a node of a reference potential. A potential of an intermediate node between the uppermost electrode and the lowermost electrode at a time of extinction is set with a potential relation in which the potential of the intermediate node is lower than a threshold voltage of the electro-optic element on a side of the reference potential and is higher than the reference potential.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

drive scanning circuitry configured to output a power potential at a first power potential and to output the power potential at a second power potential;

writing scanning circuitry configured to output a writing scanning signal at a first logic level and to output the writing scanning signal at a second logic level;

a sampling transistor that is controllable by the writing scanning signal to electrically connect a signal line to a plate of a capacitor when the writing scanning signal is at the first logic level and to electrically disconnect the signal line from the plate of the capacitor when the writing scanning signal is at the second logic level; and an organic layer between a connection layer and a lowermost electrode of a light-emitting portion in a sectional configuration of the light-emitting portion, where an electro-optic element includes the connection layer, the organic layer and the lowermost electrode, wherein a potential of the connection layer at a transition of the power potential from the first power potential to the second power potential is set with a potential relation in which the potential of the connection layer is lower than a threshold voltage of the electro-optic element and is higher than a reference potential, and wherein the writing scanning circuitry is configured to hold the writing scanning signal at the second logic level throughout the transition of the power potential from the first power potential to the second power potential.

2. The display device according to claim 1, further comprising:

a driving transistor that is switchable between allowing an uppermost electrode of the light-emitting portion to receive the power potential and preventing the uppermost electrode from receiving the power potential.

3. The display device according to claim 2, wherein the light-emitting portion is configured to emit light.

4. The display device according to claim 2, wherein the plate of the capacitor is electrically connected to a gate of the driving transistor.

5. The display device according to claim 2, wherein the uppermost electrode is an anode of the light-emitting portion.

6. The display device according to claim 2, further comprising:

another organic layer between the uppermost electrode and the connection layer of the light-emitting portion in the sectional configuration of the light-emitting portion.

7. The display device according to claim 6, further comprising:

a common power line electrically connected to the lowermost electrode.

8. The display device according to claim 6, wherein the lowermost electrode is a cathode of the light-emitting portion.

9. The display device according to claim 6, wherein the lowermost electrode is configured to receive the reference potential.

10. The display device according to claim 2, wherein another plate of the capacitor is electrically connected to a source/drain of the driving transistor.

11. The display device according to claim 10, wherein the source/drain of the driving transistor is electrically connected to the uppermost electrode.

12. The display device according to claim 1, wherein an extinction period commences at the transition of the power potential from the first power potential to the second power potential.

13. An electronic apparatus comprising:

the display device according to claim 1.

* * * * *